US010962893B2

(12) United States Patent
Suzuki et al.

(10) Patent No.: US 10,962,893 B2
(45) Date of Patent: Mar. 30, 2021

(54) PHOTOSENSITIVE BODY FOR ELECTROPHOTOGRAPHY, METHOD FOR PRODUCING SAME AND ELECTROPHOTOGRAPHIC APPARATUS

(71) Applicant: FUJI ELECTRIC CO., LTD., Kawasaki (JP)

(72) Inventors: Shinjiro Suzuki, Matsumoto (JP); Seizo Kitagawa, Matsumoto (JP); Yuji Ogawa, GuangDong (CN)

(73) Assignee: FUJI ELECTRIC CO., LTD., Kawasaki (JP)

( * ) Notice: Subject to any disclaimer, the term of this patent is extended or adjusted under 35 U.S.C. 154(b) by 0 days.

(21) Appl. No.: 16/020,101

(22) Filed: Jun. 27, 2018

(65) Prior Publication Data

US 2018/0307147 A1 Oct. 25, 2018

Related U.S. Application Data

(63) Continuation of application No. PCT/JP2017/018100, filed on May 12, 2017.

(30) Foreign Application Priority Data

Jul. 22, 2016 (JP) ..... JP2016-144853

(51) Int. Cl.
*G03G 5/06* (2006.01)
*G03G 5/047* (2006.01)
*G03G 5/05* (2006.01)

(52) U.S. Cl.
CPC ..... *G03G 5/0651* (2013.01); *G03G 5/047* (2013.01); *G03G 5/0525* (2013.01); *G03G 5/0564* (2013.01); *G03G 5/0614* (2013.01); *G03G 5/0696* (2013.01); *G03G 5/06147* (2020.05); *G03G 5/061446* (2020.05); *G03G 5/061473* (2020.05)

(58) Field of Classification Search
CPC .. G03G 5/0648; G03G 5/0614; G03G 5/0564; G03G 5/0696; G03G 5/061446; G03G 5/06147; G03G 5/061473; G03G 5/0651
See application file for complete search history.

(56) References Cited

U.S. PATENT DOCUMENTS 4,882,253 A 11/1989 Kato et al.
5,468,583 A * 11/1995 Gruenbaum ..... G03G 5/047 430/58.5
6,656,650 B1 12/2003 Lin et al.
7,163,771 B2 * 1/2007 Ioannidis ..... G03G 5/0605 430/58.15
7,223,507 B2 * 5/2007 Ioannidis ..... G03G 5/0609 430/56
8,236,469 B2 * 8/2012 Belknap ..... G03G 5/0564 430/56
8,304,153 B2 * 11/2012 Shimada ..... G03G 5/0605 399/159
8,380,109 B2 * 2/2013 Kurimoto ..... G03G 5/0614 399/159
2002/0076632 A1 * 6/2002 Yanus ..... G03G 5/0614 430/58.75

(Continued)

FOREIGN PATENT DOCUMENTS

CN 101386621 A 3/2009
JP H03-256050 A 11/1991

(Continued)

OTHER PUBLICATIONS

English language machine translation of JP 2008-310291 (Dec. 2008).*
Borsenberger, P.M.; Gruenbaum, W.T.; Magin, E.H.; Visser, S.A. Electron Trapping in Acceptor Doped Polymers. Phys. Stat. Sol. (a) 166, 835-842 (Year: 1998).*
English language machine translation of JP 2000-019748 (Jan. 2000).*
English language machine translation of JP 2000-214609 (Aug. 2000).*
English language machine translation of JP 2005-141064. (Year: 2005).*

(Continued)

*Primary Examiner* — Christopher D Rodee
(74) *Attorney, Agent, or Firm* — Rabin & Berdo, P.C.

(57) ABSTRACT

An electrophotographic photoreceptor includes a conductive substrate; and a photosensitive layer arranged on the conductive substrate and containing, as a charge generating material, any one material selected from the group consisting of titanyl phthalocyanines, metal-free phthalocyanines, chlorogallium phthalocyanines and hydroxygallium phthalocyanines; and, as an electron transporting material, a naphthalene tetracarboxylic acid diimide compound represented by Formula (1) below, where $R^1$ and $R^2$ each represent a hydrogen atom, an alkyl group having 1 to 10 carbon atoms, an alkylene group, an alkoxy group, an alkyl ester group, a phenyl group optionally having a substituent, a naphthyl group optionally having a substituent, or a halogen element; and $R^1$ and $R^2$ are optionally the same or different:

(1)

The photoreceptor realizes a stable print density even in a low-temperature environment by suppressing a reduction in print density that is caused by potential fluctuation of the photoreceptor in the low-temperature environment.

4 Claims, 2 Drawing Sheets

(56) References Cited

U.S. PATENT DOCUMENTS

| | | | | |
|---|---|---|---|---|
| 2003/0211413 | A1 | 11/2003 | Lin et al. | |
| 2004/0049027 | A1* | 3/2004 | Hamasaki | C09B 47/045 540/135 |
| 2004/0096761 | A1 | 5/2004 | Lin et al. | |
| 2004/0197685 | A1 | 10/2004 | Ioannidis et al. | |
| 2006/0014097 | A1* | 1/2006 | Perry | G03G 5/0503 430/133 |
| 2006/0292468 | A1* | 12/2006 | Yokota | G03G 5/047 430/58.65 |
| 2009/0068577 | A1 | 3/2009 | Ohta et al. | |
| 2011/0091799 | A1 | 4/2011 | Nakamura et al. | |
| 2012/0003574 | A1 | 1/2012 | Kitagawa et al. | |
| 2014/0199619 | A1* | 7/2014 | Kitagawa | G03G 5/0525 430/56 |

FOREIGN PATENT DOCUMENTS

| | | | | |
|---|---|---|---|---|
| JP | H04-241359 | A | | 8/1992 |
| JP | H04-242259 | A | | 8/1992 |
| JP | H05-012702 | B2 | | 2/1993 |
| JP | H05-045915 | A | | 2/1993 |
| JP | H05-030262 | B2 | | 5/1993 |
| JP | H05-047822 | B2 | | 7/1993 |
| JP | H07-160017 | A | | 6/1995 |
| JP | 10017531 | A | * | 1/1998 |
| JP | 2000-019748 | A | | 1/2000 |
| JP | 2000019748 | A | * | 1/2000 |
| JP | 2000214609 | A | * | 8/2000 |
| JP | 2001-228637 | A | | 8/2001 |
| JP | 2004-038167 | A | | 2/2004 |
| JP | 2004-170984 | A | | 6/2004 |
| JP | 2004-269441 | A | | 9/2004 |
| JP | 2004-310089 | A | | 11/2004 |
| JP | 2005141064 | A | * | 6/2005 |
| JP | 2005-208617 | A | | 8/2005 |
| JP | 2005-208618 | A | | 8/2005 |
| JP | 2007-011356 | A | | 1/2007 |
| JP | 2007108652 | A | * | 4/2007 |
| JP | 2007232984 | A | * | 9/2007 |
| JP | 2007-322576 | A | | 12/2007 |
| JP | 2008310291 | A | * | 12/2008 |
| JP | 2009-222894 | A | | 10/2009 |
| JP | 2009-288569 | A | | 12/2009 |
| JP | 2009-292802 | A | | 12/2009 |
| JP | 2010-181585 | A | | 8/2010 |
| JP | 2012-137667 | A | | 7/2012 |
| JP | 2014-146001 | A | | 8/2014 |
| JP | 2014178650 | A | * | 9/2014 |
| JP | 2015-094839 | A | | 5/2015 |
| WO | WO-2009/104571 | A1 | | 8/2009 |
| WO | WO-2013/021430 | A1 | | 2/2013 |

OTHER PUBLICATIONS

English language machine translation of JP 2007-108652. (Year: 2007).*

English language machine translation of JP 10-017531 (Year: 1998).*

English language machine translation of JP 2007-232984. (Year: 2007).*

* cited by examiner

PHOTOSENSITIVE BODY FOR ELECTROPHOTOGRAPHY, METHOD FOR PRODUCING SAME AND ELECTROPHOTOGRAPHIC APPARATUS

CROSS-REFERENCE TO RELATED APPLICATIONS

This non-provisional application is a continuation of International Application No. PCT/JP2017/018100 filed on May 12, 2017, which claims priority from Japanese Patent Application No. 2016-144853 filed on Jul. 22, 2016, the entire contents of both of which are incorporated herein by reference.

BACKGROUND OF THE INVENTION

1. Field of the Invention

The present invention relates to: an electrophotographic photoreceptor (hereinafter, also simply referred to as "photoreceptor") used in electrophotographic printers, copying machines, fax machines and the like; a method of producing the same; and an electrophotographic apparatus. More particularly, the present invention relates to: an electrophotographic photoreceptor which is capable of stably realizing excellent electrical characteristics by containing a specific electron transporting material in a photosensitive layer; a method of producing the same; and an electrophotographic apparatus.

2. Background of the Related Art

Electrophotographic photoreceptors have a basic structure in which a photosensitive layer having a photoconductive function is disposed on a conductive substrate. In recent years, organic electrophotographic photoreceptors using an organic compound as a functional component for generation and transport of charge have been not only actively studied and developed but also increasingly applied to copying machines, printers and the like because of their advantages such as material diversity, high productivity, and safety.

Generally, photoreceptors are required to have a function of retaining a surface charge in dark places and a function of generating a charge upon receiving light, as well as a function of transporting the thus generated charge. Such photoreceptors include: so-called single layer-type photoreceptors that comprise a single photosensitive layer having a combination of these functions; and so-called laminate-type (function-separated) photoreceptors that comprise a photosensitive layer in which functionally separated layers, such as a charge generation layer mainly having a function of generating a charge upon receiving light and a charge transport layer having both functions of retaining a surface charge in dark places and transporting the charge generated by the charge generation layer upon receiving light, are laminated.

Among these photoreceptors, positively-chargeable organic photoreceptors, in which charging characteristics of a photoreceptor surface is used for a positive charge, have layer structures that are roughly classified into four types as described below, and a variety of such layer structures have been previously proposed. The first structure is a two-layer structure of a function-separated photoreceptor in which a charge transport layer and a charge generation layer are sequentially laminated on a conductive substrate (see, for example, Patent Document 1, Japanese Patent Publication No. H05-30262, and Patent Document 2, Japanese Unexamined Patent Application Publication No. H04-242259). The second structure is a three-layer structure of a function-separated photoreceptor in which a surface protective layer is laminated on the above-described two-layer structure (see, for example, Patent Document 3, Japanese Patent Publication No. H05-47822; Patent Document 4, Japanese Patent Publication No. H05-12702; and Patent Document 5, Japanese Unexamined Patent Application Publication No. H04-241359). The third structure is a two-layer structure of a function-separated photoreceptor in which a charge generation layer and a charge (electron) transport layer are sequentially laminated in the reverse order to that of the first structure (see, for example, Patent Document 6, Japanese Unexamined Patent Application Publication No. H05-45915, and Patent Document 7, Japanese Unexamined Patent Application Publication No. H07-160017). The fourth structure is of a single layer-type photoreceptor in which a charge generating material, a hole transporting material and an electron transporting material are dispersed in the same single layer (see, for example, Patent Document 6 and Patent Document 8, Japanese Unexamined Patent Application Publication No. H03-256050). It is noted here that the above-described 4-type classification does not take into account the presence or absence of an undercoat layer.

Thereamong, single layer-type photoreceptors having the fourth structure have been studied in detail and generally and widely put into practical use. A major reason for this is believed to be because single layer-type photoreceptors adopt a structure in which the electron transport function of an electron transporting material, whose transport capacity is inferior to the hole transport function of a hole transporting material, is complemented by the hole transporting material. Such single layer-type photoreceptors are dispersed-type photoreceptors, and carriers are thus generated inside the film as well; however, since the number of generated carriers increases toward the vicinity of the photosensitive layer surface and this makes the electron transport distance shorter than the hole transport distance, it is believed that the electron transport capacity does not have to be as high as the hole transport capacity. This allows single layer-type photoreceptors having the fourth structure to realize practically sufficient environmental stability and fatigue characteristics as compared to other three types.

In single layer-type photoreceptors, since a single layer is imparted with both functions of carrier generation and carrier transport, there are advantages that the coating process can be simplified and high yield rate and process capacity are likely to be attained; however, there are also problems in that the content of a binder resin is reduced and the durability is consequently impaired when both a hole transporting material and an electron transporting material are incorporated in large amounts into a single layer in order to increase the sensitivity and the speed. Therefore, single layer-type photoreceptors have limitations in terms of achieving high performance for both in sensitivity and speed and in durability.

Accordingly, in conventional single layer-type positively-chargeable organic photoreceptors, it is difficult to implement measures for concurrently achieving such sensitivity, durability and contamination resistance that conform to the recent reduction in size and increase in speed of devices as well as increase in resolution and colorization. Therefore, novel laminate-type positively-chargeable photoreceptors in which a charge transport layer and a charge generation layer are sequentially laminated have been proposed as well (see, for example, Patent Document 9, Japanese Unexamined Patent Application Publication No. 2009-288569, and Patent Document 10, WO 2009/104571). The layer structure of these laminate-type positively-chargeable photoreceptors is similar to the above-described layer structure of the first type; however, in this layer structure, the resin ratio in the charge generation layer can be set to be higher than that in a conventional single layer-type photoreceptor and an increase in both sensitivity and durability can thus be easily achieved since not only the amount of a charge generating material contained in the charge generation layer can be reduced while incorporating an electron transporting material and the thickness of the charge generation layer can be increased to be close to that of the charge transport layer therebelow, but also the amount of a hole transporting material to be added in the charge generation layer can be reduced.

Moreover, in association with the development and increase in usage of color printers, the printing speed has been increased and the printer size and the number of printer components have been further reduced, and the printers are demanded to cope with a variety of use environments. Under such circumstances, there is a pressing need for a photoreceptor that exhibits little variation in image and electrical characteristics caused by repeated use and fluctuations in the use environment (room temperature and ambient conditions), and conventional technologies can no longer simultaneously and adequately satisfy these demands. Particularly, it is demanded to resolve the problem of a reduction in print density that is caused by potential fluctuation of a photoreceptor in a low-temperature environment.

As a concrete improvement method, for example, Patent Document 11, Japanese Unexamined Patent Application Publication No. 2015-94839, describes that an electrophotographic photoreceptor that is highly sensitive and extremely stable against environmental variations was obtained by using a butanediol-added titanyl phthalocyanine as a charge generating material in combination with a naphthalene tetracarboxylic acid diimide compound as a charge transporting material.

An object of the present invention is to provide: an electrophotographic photoreceptor with which a stable print density can be realized even in a low-temperature environment by suppressing the above-described reduction in print density that is caused by potential fluctuation of the photoreceptor in a low-temperature environment; a method of producing the same; and an electrophotographic apparatus.

SUMMARY OF THE INVENTION

The present inventors intensively studied to discover that, by incorporating, into a photosensitive layer, a prescribed phthalocyanine compound as a charge generating material along with a prescribed naphthalene tetracarboxylic acid diimide compound as an electron transporting material, an electrophotographic photoreceptor which can yield a stable print density even in a low-temperature environment can be provided.

That is, a first embodiment of the present invention is an electrophotographic photoreceptor comprising: a conductive substrate; and a photosensitive layer arranged on the conductive substrate, wherein the photosensitive layer comprises: as a charge generating material, any one material selected from the group consisting of titanyl phthalocyanines, metal-free phthalocyanines, chlorogallium phthalocyanines and hydroxygallium phthalocyanines; and, as an electron transporting material, a naphthalene tetracarboxylic acid diimide compound represented by the following Formula (1):

(1)

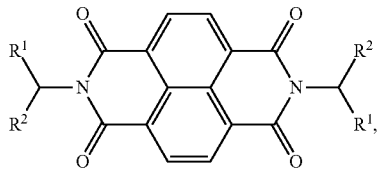

where $R^1$ and $R^2$ each represent a hydrogen atom, an alkyl group having 1 to 10 carbon atoms, an alkylene group, an alkoxy group, an alkyl ester group, a phenyl group optionally having a substituent, a naphthyl group optionally having a substituent, or a halogen element; and $R^1$ and $R^2$ are optionally the same or different.

It is preferred that the photosensitive layer be a laminate-type positively-chargeable photosensitive layer in which a charge transport layer, which contains at least a hole transporting material and a resin binder, and a charge generation layer, which contains at least the charge generating material, a hole transporting material, the electron transporting material and a resin binder, are sequentially laminated. In this case, it is preferred that the charge transport layer contain: any one compound represented by Formulae (2) to (5) below as the above-described hole transporting material; and a polycarbonate resin having a repeating unit represented by Formula (6) below as the above-described resin binder, and that the charge generation layer contain: a titanyl phthalocyanine as the above-described charge generating material; any one compound represented by the Formulae (2) to (5) as the above-described hole transporting material; any one compound represented by (E-2), (E-5) and (E-11) below as the above-described electron transporting material; and a polycarbonate resin having a repeating unit represented by Formula (6) below as the above-described resin binder:

(2)

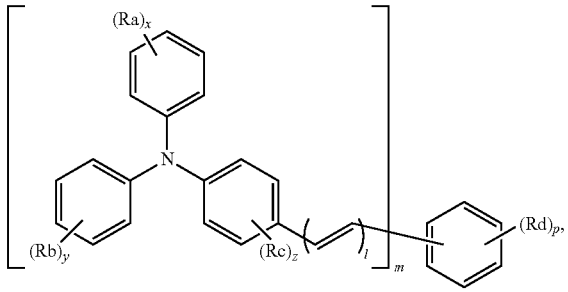

(3)

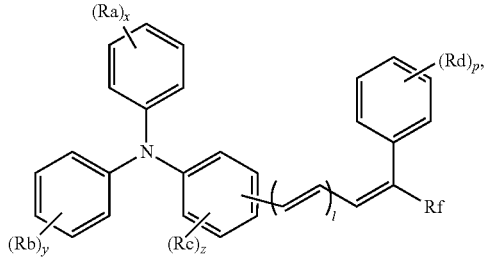

-continued (4)

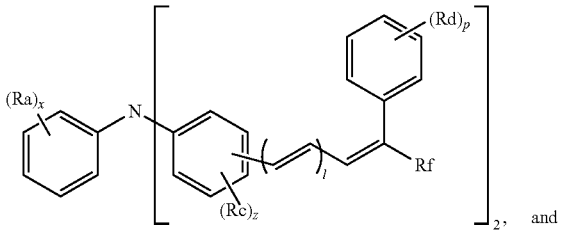

and (5)

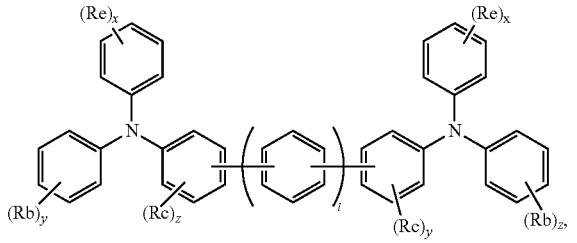

where Ra and Rd each represent a hydrogen atom, an optionally branched alkyl group having 1 to 6 carbon atoms, an alkoxy group having 1 to 6 carbon atoms, a phenyl group optionally having a substituent, or a styryl group optionally having a substituent; Rb and Rc each represent a hydrogen atom, an optionally branched alkyl group having 1 to 6 carbon atoms, or an alkoxy group having 1 to 6 carbon atoms; Re and Rf each represent a hydrogen atom, an optionally branched alkyl group having 1 to 6 carbon atoms, an alkoxy group having 1 to 3 carbon atoms, a phenyl group optionally having a substituent, a styryl group optionally having a substituent, or a 4-phenyl butadiene group optionally having a substituent; x, y and p each represent an integer of 0 to 5; z represents an integer of 0 to 4; l represents an integer of 0 to 2; and m represents an integer of 1 to 4;

(6)

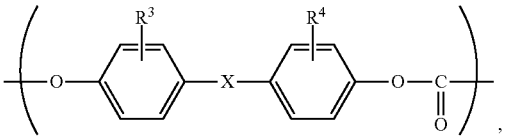

where $R^3$ and $R^4$ each represent a hydrogen atom, a methyl group, or an ethyl group; X represents an oxygen atom, a sulfur atom, or —$CR^5R^6$; $R^5$ and $R^6$ each represent a hydrogen atom, an alkyl group having 1 to 4 carbon atoms, or a phenyl group optionally having a substituent, or $R^5$ and $R^6$ are optionally cyclically bound to form a cycloalkyl group having 4 to 6 carbon atoms, which optionally has a substituent; and $R^5$ and $R^6$ are optionally the same or different; and (E-2)

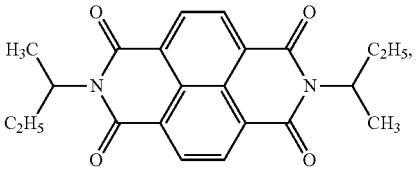

-continued (E-5)

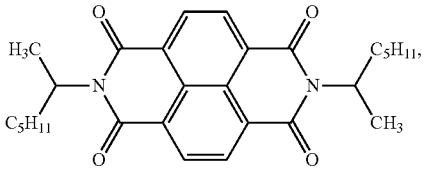

(E-11)

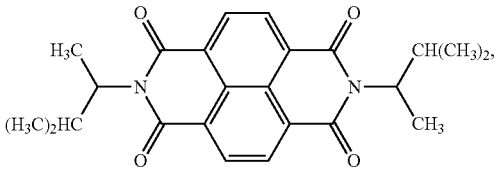

It is also preferred that the photosensitive layer be a single layer-type positively-chargeable photosensitive layer which contains, in a single layer, a charge generating material, a hole transporting material, an electron transporting material, and a resin binder. In this case, it is preferred that the photosensitive layer contain: a metal-free phthalocyanine as the above-described charge generating material; any one compound represented by the Formulae (2) to (5) above as the above-described hole transporting material; any one compound represented by the Formulae (E-2), (E-5) and (E-11) above as the above-described electron transporting material; and a polycarbonate resin having a repeating unit represented by the Formula (6) above as the above-described resin binder.

Further, the method of producing an electrophotographic photoreceptor according to a second embodiment of the present invention is a method of producing an electrophotographic photoreceptor comprising a photosensitive layer on a conductive substrate, the method comprising: a step of forming the photosensitive layer using any one material selected from the group consisting of titanyl phthalocyanines, metal-free phthalocyanines, chlorogallium phthalocyanines and hydroxygallium phthalocyanines as a charge generating material along with a naphthalene tetracarboxylic acid diimide compound represented by the Formula (1) as an electron transporting material.

Still further, the electrophotographic apparatus according to a third embodiment of the present invention is equipped with the above-described electrophotographic photoreceptor.

According to the above-described embodiments of the present invention, an electrophotographic photoreceptor with which a stable print density can be realized even in a low-temperature environment by suppressing a reduction in print density that is caused by potential fluctuation of the photoreceptor in a low-temperature environment; a method of producing the same; and an electrophotographic apparatus can be provided.

DETAILED DESCRIPTION OF THE INVENTION

Figure 1:
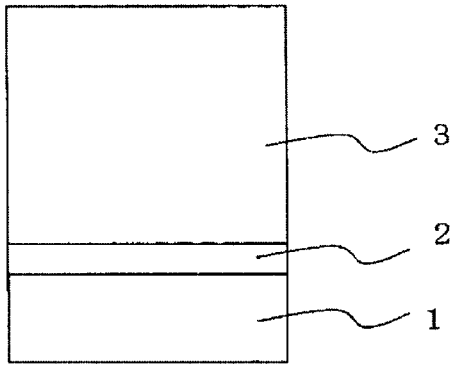
FIG. 1 is a schematic cross-sectional view showing one example of the electrophotographic photoreceptor of the present invention.

Concrete embodiments of the electrophotographic photoreceptor of the present invention will now be described in detail referring to the drawings. The present invention, however, is not restricted to the following descriptions by any means.

FIG. 1 is a schematic cross-sectional view showing one example of the electrophotographic photoreceptor of the present invention, which is a positively-chargeable single layer-type electrophotographic photoreceptor. As illustrated, in the positively-chargeable single layer-type photoreceptor, an undercoat layer 2 and a single layer-type photosensitive layer 3, which has both a charge generation function and a charge transport function, are sequentially laminated on a conductive substrate 1.

Figure 2:
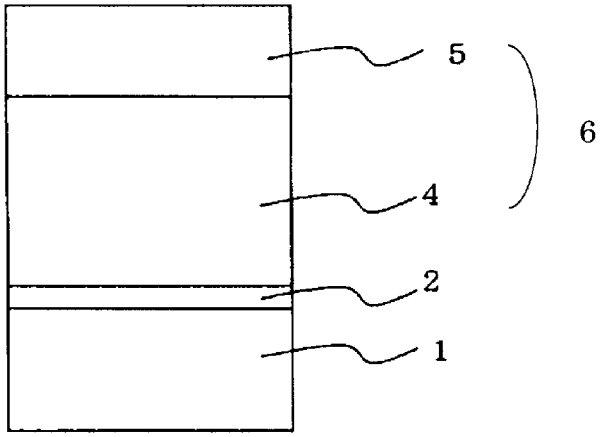
FIG. 2 is a schematic cross-sectional view showing another example of the electrophotographic photoreceptor of the present invention.

Further, FIG. 2 is a schematic cross-sectional view showing another example of the electrophotographic photoreceptor of the present invention, which is a positively-chargeable laminate-type electrophotographic photoreceptor. As illustrated, in the positively-chargeable laminate-type photoreceptor, a laminate-type positively-chargeable photosensitive layer 6, in which a charge transport layer 4 having a charge transport function and a charge generation layer 5 having a charge generation function are sequentially laminated, is arranged on the surface of the conductive substrate 1 having a cylindrical form with the undercoat layer 2 in between. It is noted here that the undercoat layer 2 may be arranged as required.

In the photoreceptor according to one embodiment of the present invention, the photosensitive layer comprises: as a charge generating material, any one material selected from the group consisting of titanyl phthalocyanines, metal-free phthalocyanines, chlorogallium phthalocyanines and hydroxygallium phthalocyanines; and, as an electron transporting material, a naphthalene tetracarboxylic acid diimide compound represented by the above-described Formula (1). The use of a combination of the specific charge generating material and the specific electron transporting material in the photosensitive layer enables to suppress potential fluctuation of the photoreceptor in a low-temperature environment and to inhibit a reduction in print density that is caused by the potential fluctuation, whereby a photoreceptor having a stable print density can be realized.

As a titanyl phthalocyanine, for example, α-type titanyl phthalocyanine, β-type titanyl phthalocyanine, Y-type titanyl phthalocyanine, amorphous titanyl phthalocyanine, or a titanyl phthalocyanine which is described in Japanese Unexamined Patent Application Publication No. H8-209023, U.S. Pat. No. 5,736,282 or 5,874,570 and has a maximum peak at a Bragg angle (2θ) of 9.6° in CuKα:X-ray diffraction spectrum can be used. As a metal-free phthalocyanine, for example, an X-type metal-free phthalocyanine or a T-type metal-free phthalocyanine can be used.

Specific examples of the naphthalene tetracarboxylic acid diimide compound that is represented by the Formula (1) and used as an electron transporting material include compounds represented by Formulae (E-1) to (E-176) below. Thereamong, from the standpoint of the solubility in the preparation of a coating solution, structures in which either or both of $R^1$ and $R^2$ is/are an alkyl group(s) are preferred.

TABLE 1

| Compound | $R^1$ | $R^2$ |
|---|---|---|
| E-1 | $—CH_3$ | $—CH_3$ |
| E-2 | $—CH_3$ | $—C_2H_5$ |
| E-3 | $—CH_3$ | $—C_3H_7$ |
| E-4 | $—CH_3$ | $—C_4H_9$ |
| E-5 | $—CH_3$ | $—C_5H_{11}$ |
| E-6 | $—CH_3$ | $—C_6H_{13}$ |
| E-7 | $—CH_3$ | $—C_7H_{15}$ |
| E-8 | $—CH_3$ | $—C_8H_{17}$ |
| E-9 | $—CH_3$ | $—C_9H_{19}$ |
| E-10 | $—CH_3$ | 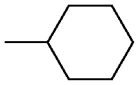 |
| E-11 | $—CH_3$ | $—CH(CH_3)_2$ |
| E-12 | $—CH_3$ | $—CH_2CH(CH_3)_2$ |
| E-13 | $—CH_3$ | $—C_2H_4CH(CH_3)_2$ |
| E-14 | —H | —H |
| E-15 | —H | $—CH_3$ |
| E-16 | —H | $—C_2H_5$ |
| E-17 | —H | $—C_3H_7$ |
| E-18 | —H | $—C_4H_9$ |
| E-19 | —H | $—C_5H_{11}$ |
| E-20 | —H | $—C_6H_{13}$ |
| E-21 | —H | $—C_7H_{15}$ |
| E-22 | —H | $—C_8H_{17}$ |
| E-23 | —H | $—C_9H_{19}$ |
| E-24 | —H | 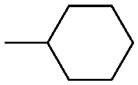 |

TABLE 2

| Compound | $R^1$ | $R^2$ |
|---|---|---|
| E-25 | $—C_2H_5$ | $—C_2H_5$ |
| E-26 | $—C_2H_5$ | $—C_3H_7$ |
| E-27 | $—C_2H_5$ | $—C_4H_9$ |
| E-28 | $—C_2H_5$ | $—C_5H_{11}$ |
| E-29 | $—C_2H_5$ | $—C_6H_{13}$ |
| E-30 | $—C_2H_5$ | $—C_7H_{15}$ |
| E-31 | $—C_2H_5$ | $—C_8H_{17}$ |
| E-32 | $—C_2H_5$ | $—C_9H_{19}$ |
| E-33 | $—C_2H_5$ | 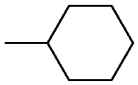 |
| E-34 | $—C_3H_7$ | $—C_3H_7$ |
| E-35 | $—C_3H_7$ | $—C_4H_9$ |
| E-36 | $—C_3H_7$ | $—C_5H_{11}$ |
| E-37 | $—C_3H_7$ | $—C_6H_{13}$ |
| E-38 | $—C_3H_7$ | $—C_7H_{15}$ |
| E-39 | $—C_3H_7$ | $—C_8H_{17}$ |
| E-40 | $—C_3H_7$ | $—C_9H_{19}$ |
| E-41 | $—C_3H_7$ | 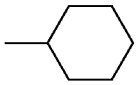 |
| E-42 | $—C_4H_9$ | $—C_4H_9$ |
| E-43 | $—C_4H_9$ | $—C_5H_{11}$ |
| E-44 | $—C_4H_9$ | $—C_6H_{13}$ |
| E-45 | $—C_4H_9$ | $—C_7H_{15}$ |
| E-46 | $—C_4H_9$ | $—C_8H_{17}$ |
| E-47 | $—C_4H_9$ | $—C_9H_{19}$ |

TABLE 2-continued

| Compound | $R^1$ | $R^2$ |
|---|---|---|
| E-48 | $—C_4H_9$ | |

TABLE 3

| Compound | $R^1$ | $R^2$ |
|---|---|---|
| E-49 | —H | |
| E-50 | —H | $H_3C$ |
| E-51 | —H | $CH_3$ |
| E-52 | —H | $CH_3$ |
| E-53 | —H | $H_3C$ $CH_3$ |
| E-54 | —H | $H_3C$ $CH_3$ |
| E-55 | —H | $H_3C$ $CH_3$ |
| E-56 | —H | $H_3C$ $H_3C$ |
| E-57 | —H | $CH_3$ $CH_3$ |

TABLE 3-continued

| Compound | $R^1$ | $R^2$ |
|---|---|---|
| E-58 | —H | $C_2H_5$ |
| E-59 | —H | $C_2H_5$ |
| E-60 | —H | $C_2H_5$ |
| E-61 | —H | |
| E-62 | —H | |
| E-63 | $—CH_3$ | |

TABLE 4

| Compound | $R^1$ | $R^2$ |
|---|---|---|
| E-64 | $—CH_3$ | $H_3C$ |
| E-65 | $—CH_3$ | $CH_3$ |
| E-66 | $—CH_3$ | $CH_3$ |
| E-67 | $—CH_3$ | $H_3C$ $CH_3$ |
| E-68 | $—CH_3$ | $H_3C$ $CH_3$ |

TABLE 4-continued
| Compound | $R^1$ | $R^2$ |
|---|---|---|
| E-69 | $—CH_3$ | 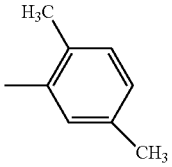 |
| E-70 | $—CH_3$ | 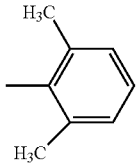 |
| E-71 | $—CH_3$ | 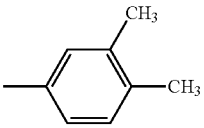 |
| E-72 | $—CH_3$ | 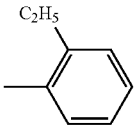 |
| E-73 | $—CH_3$ | 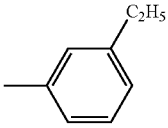 |
| E-74 | $—CH_3$ | 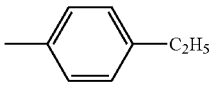 |
| E-75 | $—CH_3$ | 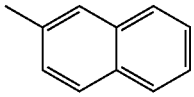 |
| E-76 | $—CH_3$ | 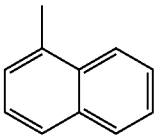 |
TABLE 5
| Compound | $R^1$ | $R^2$ |
|---|---|---|
| E-77 | $—C_2H_5$ | 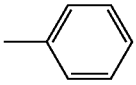 |
| E-78 | $—C_2H_5$ | 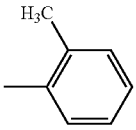 |
TABLE 5-continued
| Compound | $R^1$ | $R^2$ |
|---|---|---|
| E-79 | $—C_2H_5$ | 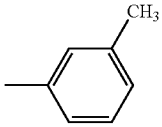 |
| E-80 | $—C_2H_5$ | 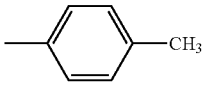 |
| E-81 | $—C_2H_5$ | 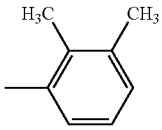 |
| E-82 | $—C_2H_5$ | 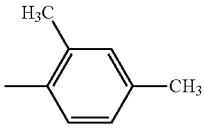 |
| E-83 | $—C_2H_5$ | 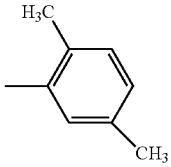 |
| E-84 | $—C_2H_5$ | 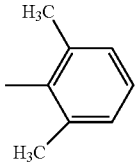 |
| E-85 | $—C_2H_5$ | 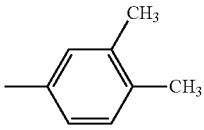 |
| E-86 | $—C_2H_5$ | 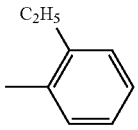 |
| E-87 | $—C_2H_5$ | 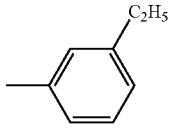 |
| E-88 | $—C_2H_5$ | 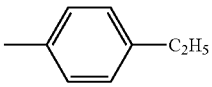 |
| E-89 | $—C_2H_5$ | 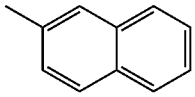 |

TABLE 5-continued

| Compound | $R^1$ | $R^2$ |
|---|---|---|
| E-90 | $—C_2H_5$ | |

TABLE 6

| Compound | $R^1$ | $R^2$ |
|---|---|---|
| E-91 | $—C_3H_7$ | |
| E-92 | $—C_3H_7$ | $H_3C$ |
| E-93 | $—C_3H_7$ | $CH_3$ |
| E-94 | $—C_3H_7$ | $CH_3$ |
| E-95 | $—C_3H_7$ | $H_3C$ $CH_3$ |
| E-96 | $—C_3H_7$ | $H_3C$ $CH_3$ |
| E-97 | $—C_3H_7$ | $H_3C$ $CH_3$ |
| E-98 | $—C_3H_7$ | $H_3C$ $H_3C$ |
| E-99 | $—C_3H_7$ | $CH_3$ $CH_3$ |

TABLE 6-continued

| Compound | $R^1$ | $R^2$ |
|---|---|---|
| E-100 | $—C_3H_7$ | $C_2H_5$ |
| E-101 | $—C_3H_7$ | $C_2H_5$ |
| E-102 | $—C_3H_7$ | $C_2H_5$ |
| E-103 | $—C_3H_7$ | |
| E-104 | $—C_3H_7$ | |

TABLE 7

| Compound | $R^1$ | $R^2$ |
|---|---|---|
| E-105 | $—C_4H_9$ | |
| E-106 | $—C_4H_9$ | $H_3C$ |
| E-107 | $—C_4H_9$ | $CH_3$ |
| E-108 | $—C_4H_9$ | $CH_3$ |
| E-109 | $—C_4H_9$ | $H_3C$ $CH_3$ |
| E-110 | $—C_4H_9$ | $H_3C$ $CH_3$ |

TABLE 7-continued
| Compound | $R^1$ | $R^2$ |
|---|---|---|
| E-111 | $—C_4H_9$ | 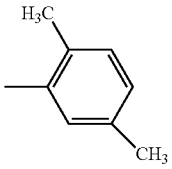 |
| E-112 | $—C_4H_9$ | 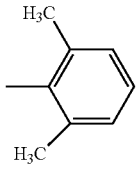 |
| E-113 | $—C_4H_9$ | 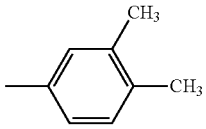 |
| E-114 | $—C_4H_9$ | 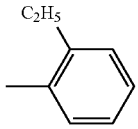 |
| E-115 | $—C_4H_9$ | 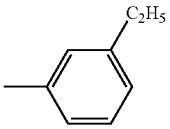 |
| E-116 | $—C_4H_9$ | 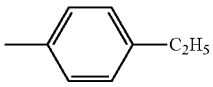 |
| E-117 | $—C_4H_9$ | 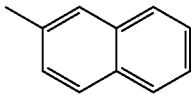 |
| E-118 | $—C_4H_9$ | 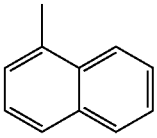 |
TABLE 8
| Compound | $R^1$ | $R^2$ |
|---|---|---|
| E-119 | $—C_5H_{11}$ | 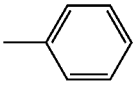 |
| E-120 | $—C_5H_{11}$ | 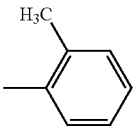 |
TABLE 8-continued
| Compound | $R^1$ | $R^2$ |
|---|---|---|
| E-121 | $—C_5H_{11}$ | 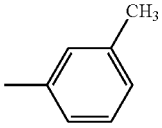 |
| E-122 | $—C_5H_{11}$ | 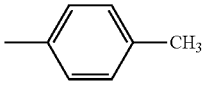 |
| E-123 | $—C_5H_{11}$ | 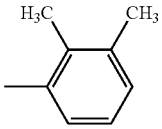 |
| E-124 | $—C_5H_{11}$ | 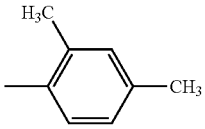 |
| E-125 | $—C_5H_{11}$ | 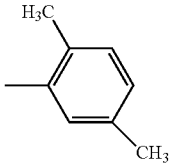 |
| E-126 | $—C_5H_{11}$ | 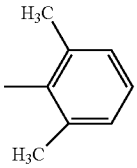 |
| E-127 | $—C_5H_{11}$ | 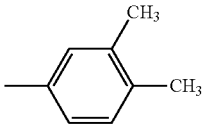 |
| E-128 | $—C_5H_{11}$ | 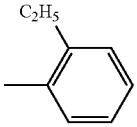 |
| E-129 | $—C_5H_{11}$ | 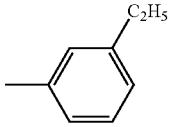 |
| E-130 | $—C_5H_{11}$ | 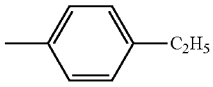 |
| E-131 | $—C_5H_{11}$ | 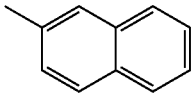 |

TABLE 8-continued

| Compound | $R^1$ | $R^2$ |
|---|---|---|
| E-132 | $—C_5H_{11}$ | |

TABLE 9

| Compound | $R^1$ | $R^2$ |
|---|---|---|
| E-133 | | |
| E-134 | | $H_3C$ |
| E-135 | | $CH_3$ |
| E-136 | | $CH_3$ |
| E-137 | | $H_3C$ $CH_3$ |
| E-138 | | $H_3C$ $CH_3$ |
| E-139 | | $H_3C$ $CH_3$ |
| E-140 | | $H_3C$ $H_3C$ |
| E-141 | | $CH_3$ $CH_3$ |

TABLE 9-continued

| Compound | $R^1$ | $R^2$ |
|---|---|---|
| E-142 | | $C_2H_5$ |
| E-143 | | $C_2H_5$ |
| E-144 | | $C_2H_5$ |
| E-145 | | |
| E-146 | | |

TABLE 10

| Compound | $R^1$ | $R^2$ |
|---|---|---|
| E-147 | $H_3C$ | $H_3C$ |
| E-148 | $H_3C$ | $CH_3$ |
| E-149 | $H_3C$ | $CH_3$ |
| E-150 | $H_3C$ | $H_3C$ $CH_3$ |
| E-151 | $H_3C$ | $H_3C$ $CH_3$ |

TABLE 10-continued
| Compound | $R^1$ | $R^2$ |
|---|---|---|
| E-152 | 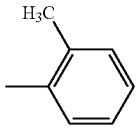 | 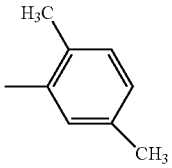 |
| E-153 | 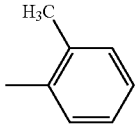 | 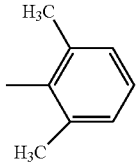 |
| E-154 | 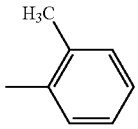 | 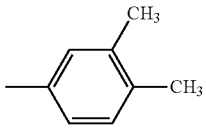 |
| E-155 | 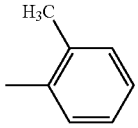 | 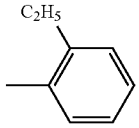 |
| E-156 | 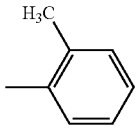 | 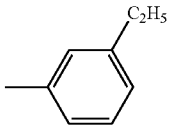 |
| E-157 | 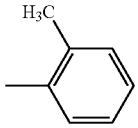 | 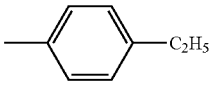 |
| E-158 | 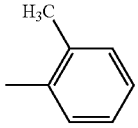 | 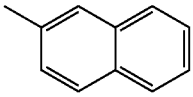 |
| E-159 | 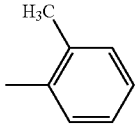 | 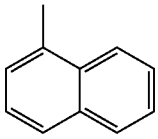 |
TABLE 11
| Compound | $R^1$ | $R^2$ |
|---|---|---|
| E-160 | 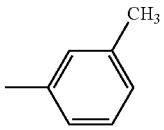 | 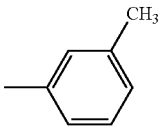 |
TABLE 11-continued
| Compound | $R^1$ | $R^2$ |
|---|---|---|
| E-161 | 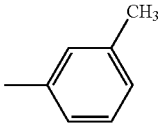 | 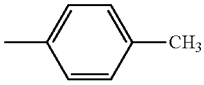 |
| E-162 | 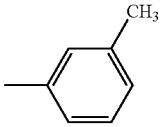 | 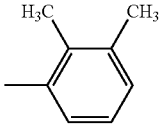 |
| E-163 | 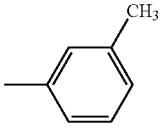 | 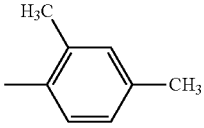 |
| E-164 | 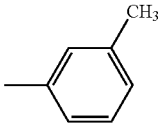 | 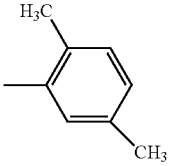 |
| E-165 | 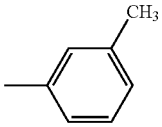 | 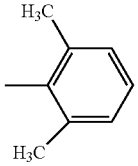 |
| E-166 | 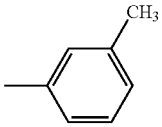 | 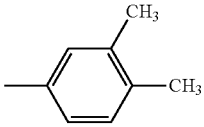 |
| E-167 | 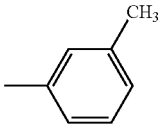 | 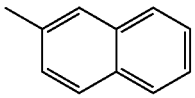 |
| E-168 | 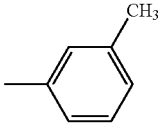 | 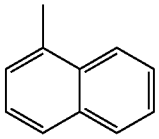 |
| E-169 | 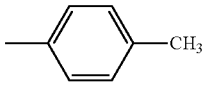 | 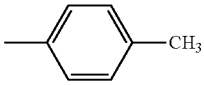 |
| E-170 | 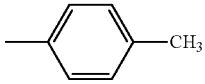 | 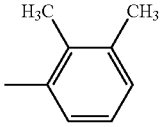 |
| E-171 | 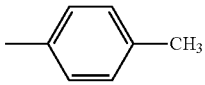 | 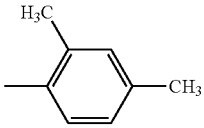 |

TABLE 11-continued

| Compound | $R^1$ | $R^2$ |
|---|---|---|
| E-172 | 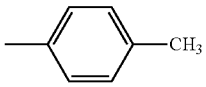 | 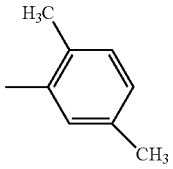 |

TABLE 12

| Compound | $R^1$ | $R^2$ |
|---|---|---|
| E-173 | 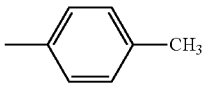 | 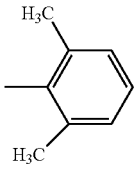 |
| E-174 | 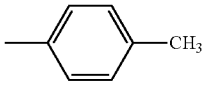 | 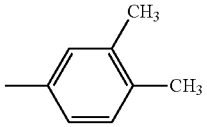 |
| E-175 | 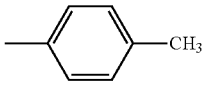 | 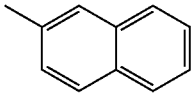 |
| E-176 | 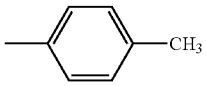 | 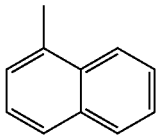 |

The conductive substrate 1 not only functions as an electrode of the photoreceptor but also serves as a support of the layers constituting the photoreceptor, and the conductive substrate 1 may take any form, such as a cylindrical form, a plate form or a film form. As the material of the conductive substrate 1, for example, a metal (e.g., aluminum, stainless steel, or nickel), or a material such as glass or resin, having a surface subjected to a conductive treatment, can be used.

The undercoat layer 2 is composed of a layer containing resin as a main component, or a metal oxide film of alumite or the like. The undercoat layer 2 is arranged as required for the purposes of, for example, controlling the injectability of a charge from the conductive substrate 1 into the photosensitive layer, covering surface defects of the conductive substrate, and improving the adhesion between the photosensitive layer and the conductive substrate 1. Examples of a resin material used in the undercoat layer 2 include insulating polymers, such as casein, polyvinyl alcohol, polyamide, melamine and cellulose; and conductive polymers, such as polythiophene, polypyrrole and polyaniline, and these resins may be used individually, or as a mixture of an appropriate combination. Further, a metal oxide such as titanium dioxide or zinc oxide may be incorporated into these resins.

Positively-Chargeable Single Layer-Type Photoreceptor

In the case of a positively-chargeable single layer-type photoreceptor, the single layer-type photosensitive layer 3 functions as a photosensitive layer containing the above-described specific charge generating material and electron transporting material. In the positively-chargeable single layer-type photoreceptor, the single layer-type photosensitive layer 3 is a single layer-type positively-chargeable photosensitive layer which mainly contains, in a single layer, a charge generating material, a hole transporting material, an electron transporting material (acceptor compound), and a resin binder.

The charge generating material of the single layer-type photosensitive layer 3 is required to contain any one material selected from the group consisting of titanyl phthalocyanines, metal-free phthalocyanines, chlorogallium phthalocyanines and hydroxygallium phthalocyanines, and one or more of other widely used charge generating materials may be used in combination as well. Examples of such other charge generating materials that can be used include phthalocyanine pigments other than the above, azo pigments, anthoanthrone pigments, perylene pigments, perinone pigments, polycyclic quinone pigments, squarylium pigments, thiapyrylium pigments, and quinacridone pigments. Particularly, disazo pigments and trisazo pigments can be used as azo pigments; N,N-bis(3,5-dimethylphenyl)-3,4:9,10-perylene-bis(carboximide) can be used as a perylene pigment; and copper phthalocyanines such as e-type copper phthalocyanine can be used as other phthalocyanine pigments. The charge generating material is effective as long as it is added in an amount of 0.1 to 20% by mass with respect to the total amount of the photosensitive layer, and a charge generating material other than titanyl phthalocyanines, metal-free phthalocyanines, chlorogallium phthalocyanines and hydroxygallium phthalocyanines can be added up to a range where the total amount of the charge generating materials is 20% by mass.

The electron transporting material of the single layer-type photosensitive layer 3 is required to contain a naphthalene tetracarboxylic acid diimide compound represented by the Formula (1), and one or more of other widely used electron transporting materials may be used in combination as well. Examples of such other electron transporting materials that can be used in combination include succinic anhydride, maleic anhydride, dibromosuccinic anhydride, phthalic anhydride, 3-nitrophthalic anhydride, 4-nitrophthalic anhydride, pyromellitic anhydride, pyromellitic acid, trimellitic acid, trimellitic anhydride, phthalimide, 4-nitrophthalimide, tetracyanoethylene, tetracyanoquinodimethane, chloranil, bromanil, o-nitrobenzoic acid, malononitrile, trinitrofluorenone, trinitrothioxanthone, dinitrobenzene, dinitroanthracene, dinitroacridine, nitroanthraquinone, dinitroanthraquinone, thiopyran compounds, quinone compounds, benzoquinone compounds, diphenoquinone compounds, naphthoquinone compounds, anthraquinone compounds, stilbenequinone compounds, and azoquinone compounds. The electron transporting material represented by the Formula (1) is effective as long as it is added in an amount of 1 to 50% by mass with respect to the total amount of the photosensitive layer, and an electron transporting material other than the one represented by the Formula (1) can be added up to a range where the total amount of the electron transporting materials is 50% by mass.

As the hole transporting material of the single layer-type photosensitive layer 3, for example, hydrazone compounds, pyrazoline compounds, pyrazolone compounds, oxadiazole compounds, oxazole compounds, arylamine compounds, benzidine compounds, stilbene compounds, styryl compounds, poly-N-vinylcarbazoles, and polysilanes can be used and, thereamong, an arylamine compound is preferred. These hole transporting materials may be used individually, or in a combination of two or more thereof. The hole transporting material is preferably one which exhibits an excellent ability to transport holes generated during irradiation with light and is suitable for combining with the charge generating material.

Examples of the suitable hole transporting material include those represented by the above-described Formulae (2) to (5). Further, as a specific example of the suitable hole transporting material, it is preferred that the hole transporting material contain any one arylamine compound represented by Formulae (H-1) to (H-30) below. From the standpoint of the stability of environmental characteristics, it is more preferred that the hole transporting material be an arylamine compound.

H-1

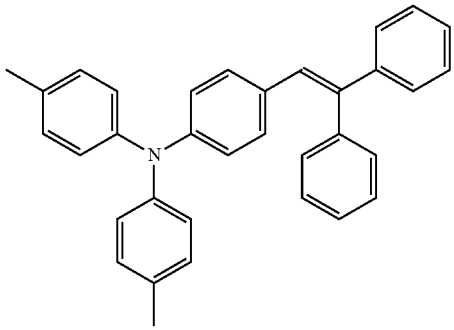

H-2

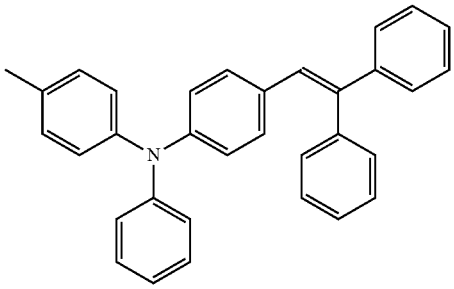

H-3

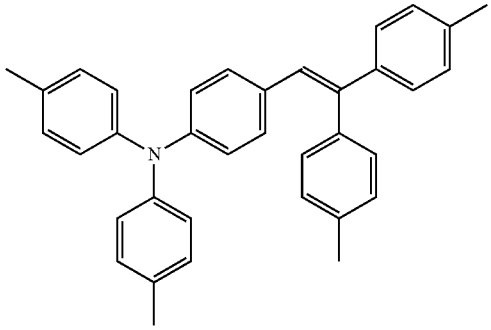

H-4

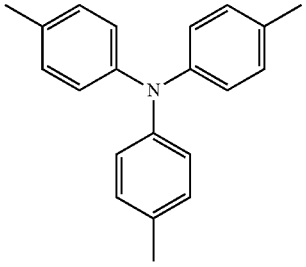

H-5

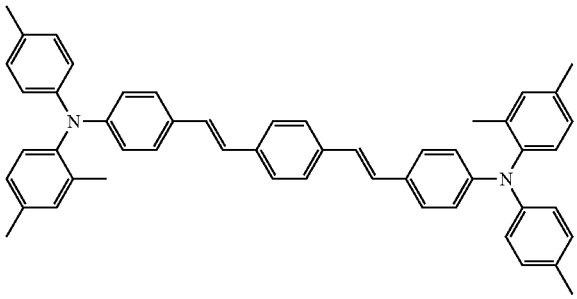

H-6

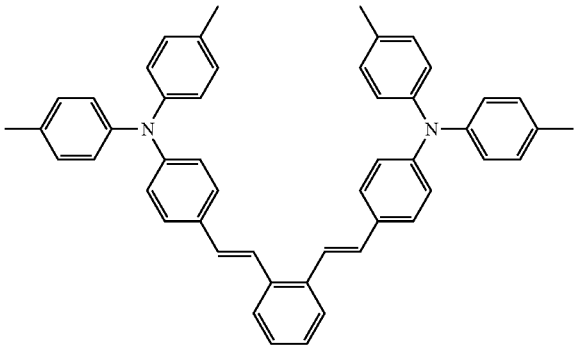

H-7

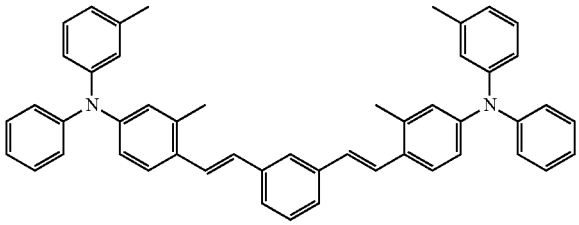

H-8

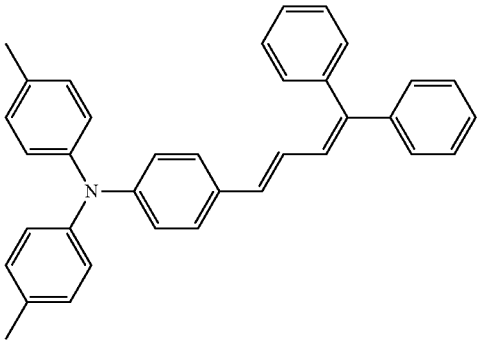

-continued
H-9
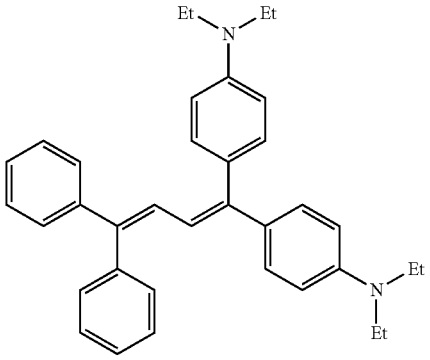
H-10
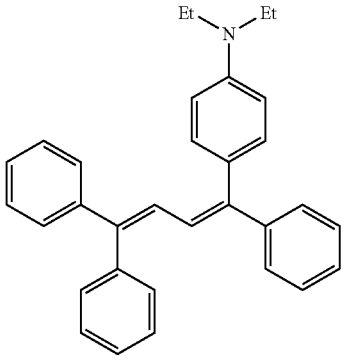
H-11
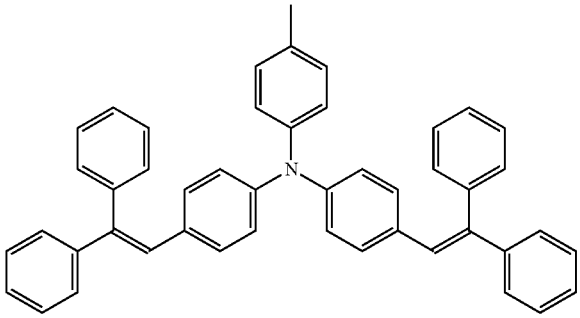
H-12
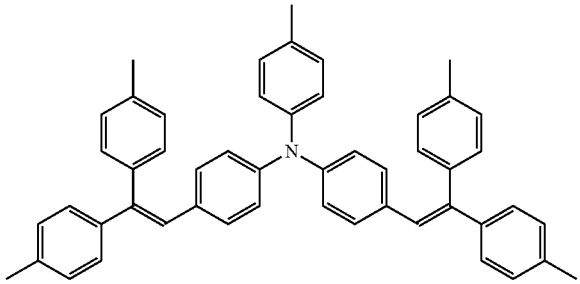
H-13
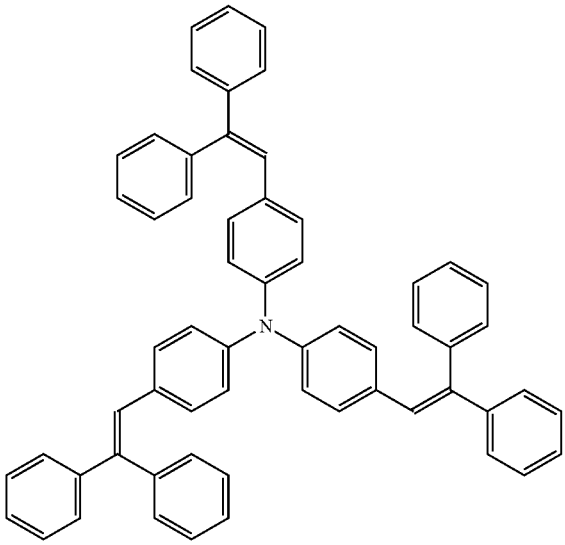
H-14
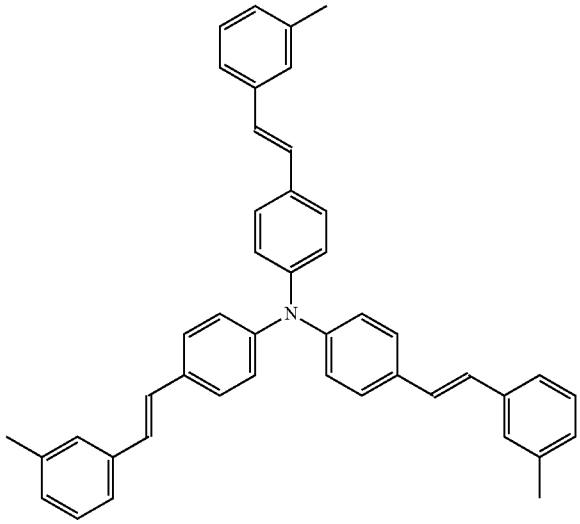

-continued
H-15
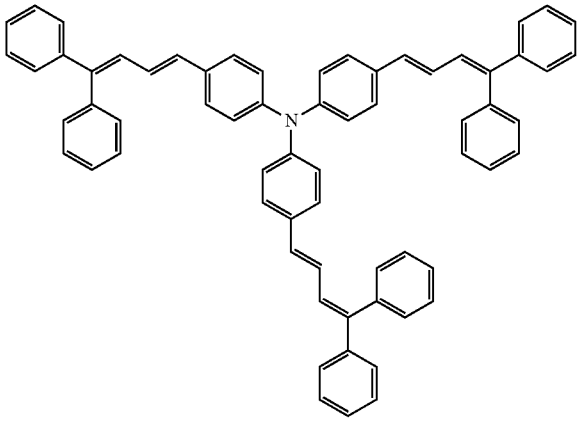
H-16
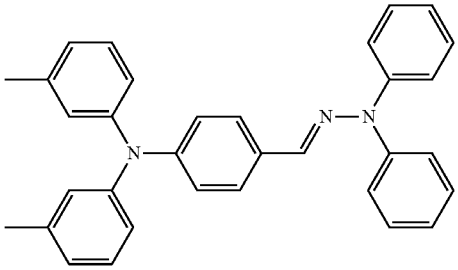
H-17
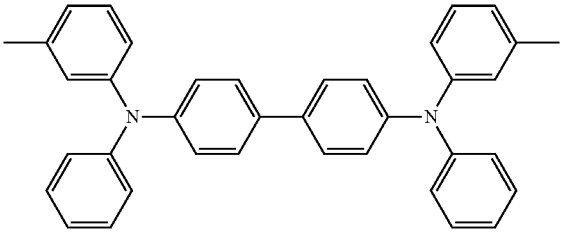
H-18
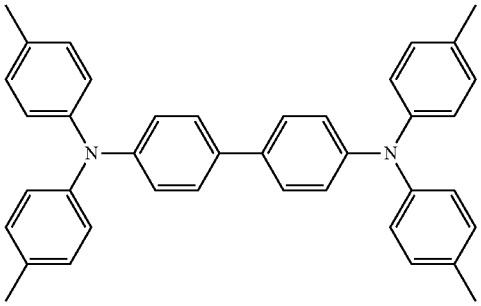
H-19
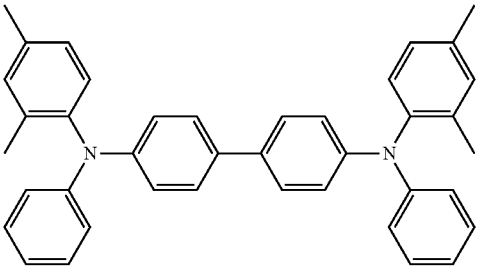
H-20
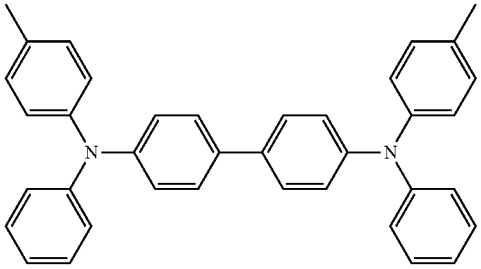
H-21
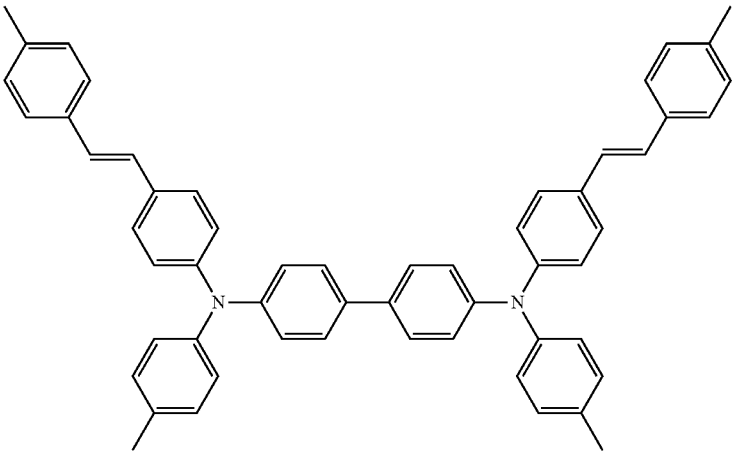

-continued
H-22
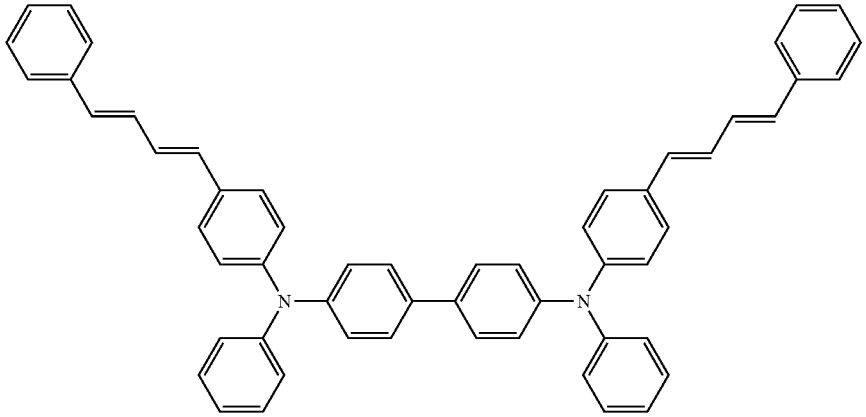
H-23
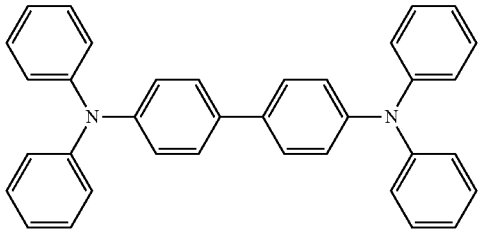
H-24
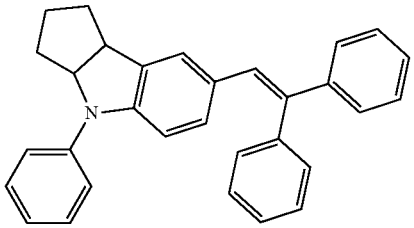
H-25
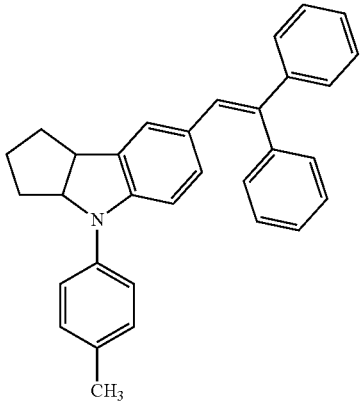
H-26
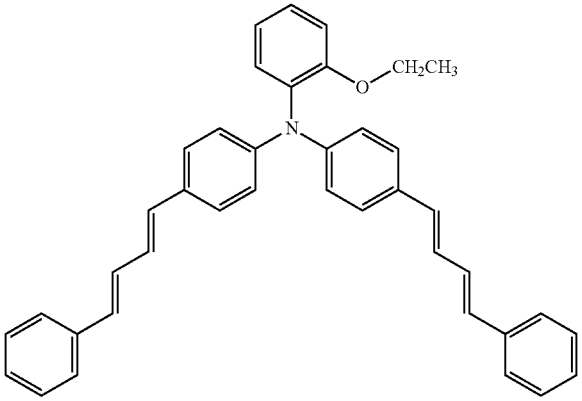
H-27
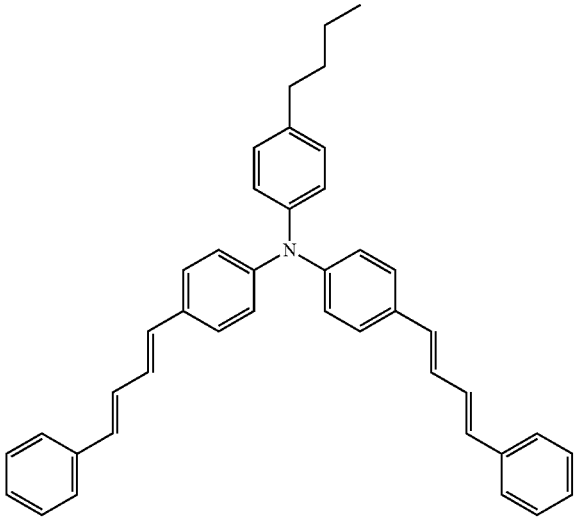
H-28
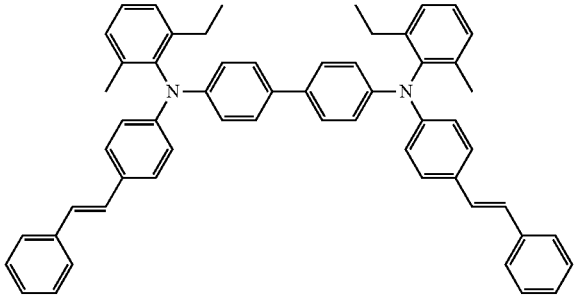

-continued

H-29

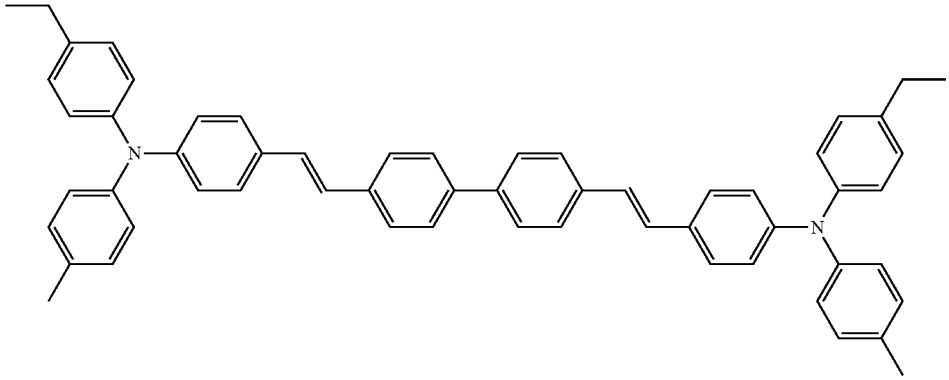

H-30

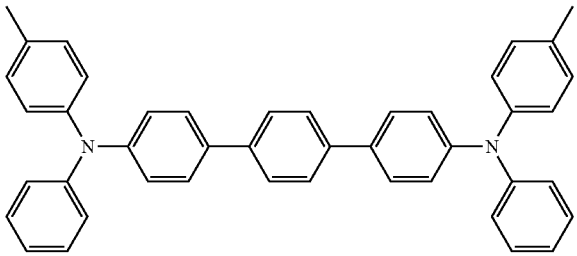

(1)

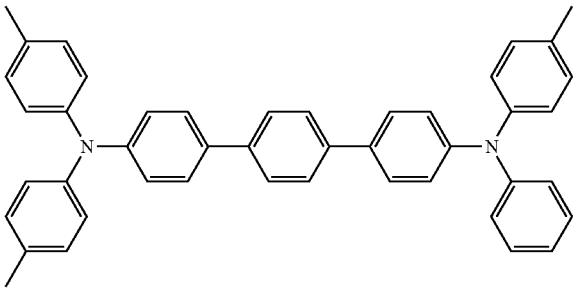

(2)

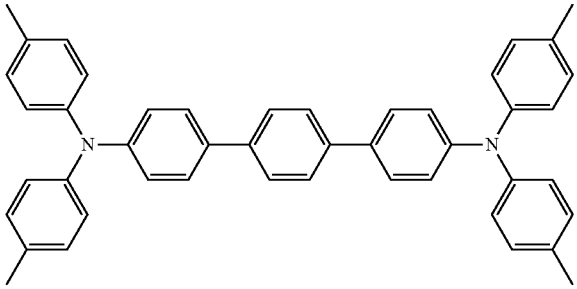

(3)

(1):(2):(3) = 1:2:1

As the resin binder of the single layer-type photosensitive layer 3, for example, various polycarbonate resins other than the above-mentioned ones, such as bisphenol A-type polycarbonates, bisphenol Z-type polycarbonates, bisphenol A-type polycarbonate-biphenyl copolymers, and bisphenol Z-type polycarbonate-biphenyl copolymers; polyphenylene resins; polyester resins; polyvinyl acetal resins; polyvinyl butyral resins; polyvinyl alcohol resins; vinyl chloride resins; vinyl acetate resins; polyethylene resins; polypropylene resins; acrylic resins; polyurethane resins; epoxy resins; melamine resins; silicone resins; polyamide resins; polystyrene resins; polyacetal resins; polyarylate resins; polysulfone resins; methacrylate polymers; and copolymers of these resins can be used. Further, a mixture of resins of the same kind but with different molecular weights may be used as well.

Examples of a suitable resin binder include polycarbonate resins having a repeating unit represented by the Formula (6). Further, more specific examples of the suitable resin binder include polycarbonate resins having any one repeating unit represented by Formulae (B-1) to (B-10) below:

B-1

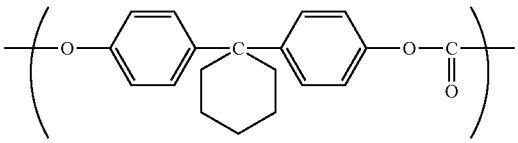

B-2

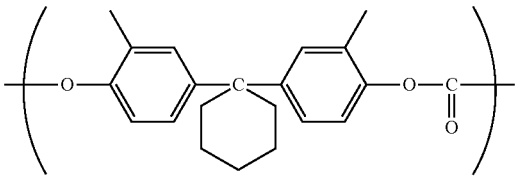

-continued

B-3

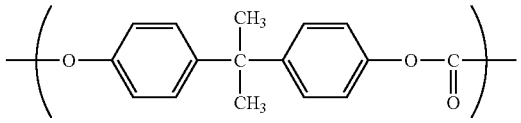

B-4

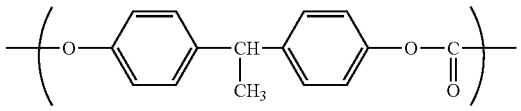

B-5

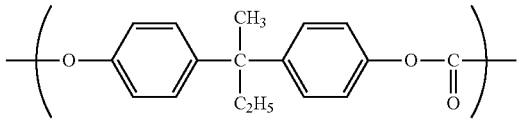

B-6

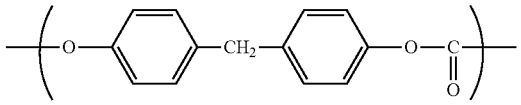

B-7

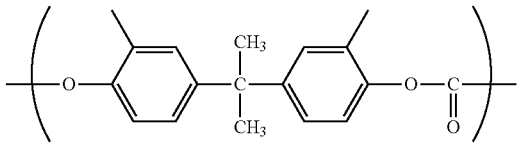

B-8

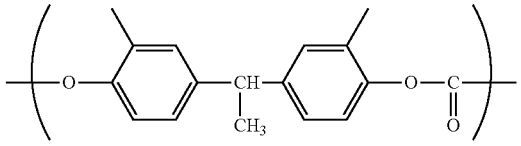

B-9

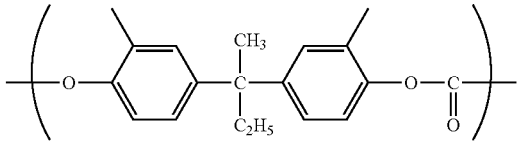

B-10

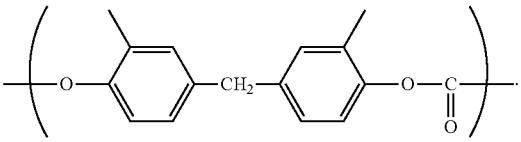

The content of the charge generating material(s) in the single layer-type photosensitive layer 3 is preferably 0.1 to 20% by mass, more preferably 0.5 to 10% by mass, with respect to the solid content of the single layer-type photosensitive layer 3. The content of the hole transporting material(s) in the single layer-type photosensitive layer 3 is preferably 3 to 80% by mass, more preferably 5 to 60% by mass, with respect to the solid content of the single layer-type photosensitive layer 3. The content of the electron transport material(s) in the single layer-type photosensitive layer 3 is preferably 1 to 50% by mass, more preferably 5 to 40% by mass, with respect to the solid content of the single layer-type photosensitive layer 3. The content of the resin binder in the single layer-type photosensitive layer 3 is preferably 10 to 90% by mass, more preferably 20 to 80% by mass, with respect to the solid content of the single layer-type photosensitive layer 3.

In order to maintain a practically effective surface potential, the thickness of the single layer-type photosensitive layer 3 is in a range of preferably 3 to 100 μm, more preferably 5 to 40 μm.

Positively-Chargeable Laminate-Type Photoreceptor

In the case of a positively-chargeable laminate-type photoreceptor, the laminate-type positively-chargeable photosensitive layer 6 constituted by the charge transport layer 4 and the charge generation layer 5 functions as a photosensitive layer containing the above-described specific charge generating material and electron transporting material. In the positively-chargeable laminate-type photoreceptor, the charge transport layer 4 contains at least a hole transporting material and a resin binder, and the charge generation layer 5 contains at least a charge generating material, a hole transporting material, an electron transporting material, and a resin binder.

As the hole transporting material and the resin binder in the charge transport layer 4, the same materials as those exemplified above for the single layer-type photosensitive layer 3 can be used.

The content of the hole transporting material in the charge transport layer 4 is preferably 10 to 80% by mass, more preferably 20 to 70% by mass, with respect to the solid content of the charge transport layer 4. The content of the resin binder in the charge transport layer 4 is preferably 20 to 90% by mass, more preferably 30 to 80% by mass, with respect to the solid content of the charge transport layer 4.

In order to maintain a practically effective surface potential, the thickness of the charge transport layer 4 is in a range of preferably 3 to 50 μm, more preferably 15 to 40 μm.

As the hole transporting material and the resin binder in the charge generation layer 5, the same materials as those exemplified above for the single layer-type photosensitive layer 3 can be used. Further, as the charge generating material in the charge generation layer 5, in the same manner as in the single layer-type photosensitive layer 3, one or more of other widely used charge generating materials may be additionally used in combination with the above-described specific charge generating material. Moreover, as the electron transporting material in the charge generation layer 5, in the same manner as in the single layer-type photosensitive layer 3, one or more of other widely used electron transporting materials may be additionally used in combination with the above-described naphthalene tetracarboxylic acid diimide compound. The contents of the respective materials and the thickness of the charge generation layer 5 can also be the same as in the single layer-type photosensitive layer 3 of the single layer-type photoreceptor.

In one embodiment of the present invention, for the purposes of improving the leveling of the resulting film and imparting lubricity, a leveling agent such as a silicone oil or a fluorine-based oil may also be incorporated into the laminate-type or single layer-type photosensitive layer. In addition, for the purposes of adjusting the film hardness, reducing the frictional coefficient, imparting lubricity and the like, plural kinds of inorganic oxides may be incorporated. For example, fine particles of a metal oxide (e.g., silica, titanium oxide, zinc oxide, calcium oxide, alumina, or zirconium oxide), a metal sulfate (e.g., barium sulfate or calcium sulfate) or a metal nitride (e.g., silicon nitride or aluminum nitride), particles of a fluorine-based resin such as tetrafluoroethylene resin, or a fluorine-based comb-type graft polymer resin may be incorporated as well. Moreover, as required, other known additive(s) may also be incorporated within a range that does not markedly impair the electrophotographic properties.

Furthermore, in the photosensitive layer, deterioration inhibitors such as an antioxidant and a light stabilizer may also be incorporated for the purpose of improving the environmental resistance and the stability against damaging light. Examples of compounds used for such a purpose include chromanol derivatives such as tocopherol, as well as esterified compounds, polyarylalkane compounds, hydroquinone derivatives, etherified compounds, dietherified compounds, benzophenone derivatives, benzotriazole derivatives, thioether compounds, phenylenediamine derivatives, phosphonates, phosphites, phenolic compounds, hindered phenol compounds, linear amine compounds, cyclic amine compounds, and hindered amine compounds.

Method of Producing Photoreceptor

The photoreceptor according to one embodiment of the present invention can be produced by forming a photosensitive layer using any one material selected from the group consisting of titanyl phthalocyanines, metal-free phthalocyanines, chlorogallium phthalocyanines and hydroxygallium phthalocyanines as a charge generating material along with a naphthalene tetracarboxylic acid diimide compound represented by the Formula (1) above as an electron transporting material. The method of producing the photoreceptor may also include: a step of preparing a conductive substrate; and a step of preparing a coating solution in which the above-described specific charge generating material and electron transporting material as well as arbitrary hole transporting material and resin binder are dissolved or dispersed in a solvent.

Specifically, a single layer-type photoreceptor can be produced by a method comprising: a step of preparing a coating solution for the formation of a single layer-type photosensitive layer by dissolving or dispersing the above-described specific charge generating material and electron transporting material as well as arbitrary hole transporting material and resin binder in a solvent; and a step of forming a photosensitive layer by coating and then drying the thus prepared coating solution for the formation of a single layer-type photosensitive layer on the outer periphery of a conductive substrate via an undercoat layer as desired.

In the case of a laminate-type photoreceptor, first, a charge transport layer is formed by a method comprising: a step of preparing a coating solution for the formation of a charge transport layer by dissolving arbitrary hole transporting material and resin binder in a solvent; and a step of forming a charge transport layer by coating and then drying the thus prepared coating solution for the formation of a charge transport layer on the outer periphery of a conductive substrate via an undercoat layer as desired. Next, a charge generation layer is formed by a method comprising: a step of preparing a coating solution for the formation of a charge generation layer by dissolving or dispersing the above-described specific charge generating material and electron transporting material as well as arbitrary hole transporting material and resin binder in a solvent; and a step of forming a charge generation layer by coating and then drying the thus prepared coating solution for the formation of a charge generation layer on the above-formed charge transport layer. The laminate-type photoreceptor of one embodiment can be produced by such a production method. The above-described coating solutions can be applied to a variety of coating methods, such as dip coating and spray coating, and are not restricted to any one coating method. Further, the types of the solvents used for the preparation of the coating solutions, the coating conditions, the drying conditions and the like can be selected as appropriate in accordance with a conventional method and are not particularly restricted.

Electrophotographic Apparatus

The electrophotographic photoreceptor according to one embodiment of the present invention exerts desired effects when applied to various machine processes. Specifically, sufficient effects can be obtained not only in charging processes such as contact charging systems using a charging member (e.g., a roller or a brush) and non-contact charging systems using a corotron or a scorotron, but also in development processes such as non-contact development and contact development systems using, for example, a non-magnetic single-component, magnetic single-component or two-component developing agent.

Figure 3:
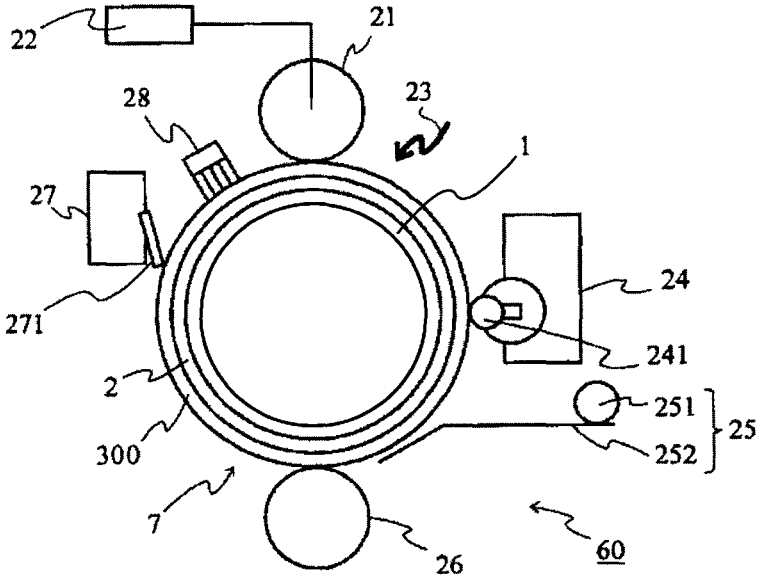
FIG. 3 is a schematic structural view showing one example of the electrophotographic apparatus of the present invention.

The electrophotographic apparatus according to one embodiment of the present invention is equipped with the above-described electrophotographic photoreceptor. FIG. 3 is a schematic structural view showing one example of the structure of the electrophotographic apparatus according to the present invention. As illustrated, an electrophotographic apparatus 60 is equipped with a photoreceptor 7 according to one embodiment of the present invention, which comprises: a conductive substrate 1; and an undercoat layer 2 and a photosensitive layer 300, which cover the outer periphery of the conductive substrate 1. This electrophotographic apparatus 60 comprises: a charging member 21 which is arranged on the outer periphery of the photoreceptor 7 and has a roller shape in the example shown in the drawing; a high-voltage power source 22 which supplies applied voltage to the charging member 21; an image exposure member 23; a developer 24 which is equipped with a development roller 241; a paper-feeding member 25 which is equipped with a paper-feeding roller 251 and a paper feed guide 252; and a transfer charger (direct charging-type) 26. The electrophotographic apparatus 60 may further comprise a cleaning device 27 equipped with a cleaning blade 271, and a charge-removing member 28. The electrophotographic apparatus 60 according to one embodiment of the present invention can be configured as a color printer.

EXAMPLES

Concrete embodiments of the present invention will now be described in more detail by way of examples thereof.

The present invention, however, is not restricted to the following Examples as long as they do not deviate from the gist of the present invention.

Laminate-Type Photoreceptor

Example 1

As a conductive substrate, a 0.75 mm-thick aluminum tube machined to have a size of φ30 mm×252.6 mm (length) and a surface roughness (Rmax) of 0.2 μm was used.

Charge Transport Layer

After dissolving 100 parts by mass of a compound represented by Formula (H-5) below as a hole transporting material and 100 parts by mass of a polycarbonate resin (viscosity-average molecular weight: 50,000) represented by Formula (BD-1) below as a resin binder in 800 parts by mass of tetrahydrofuran, 0.1 parts by mass of a silicone oil (KP-340, manufactured by Shin-Etsu Polymer Co., Ltd.) was added to prepare a coating solution. This coating solution was coated on the above-described conductive substrate, and the resultant was dried at 100° C. for 30 minutes, whereby a 15 μm-thick charge transport layer was formed.

(H-5)

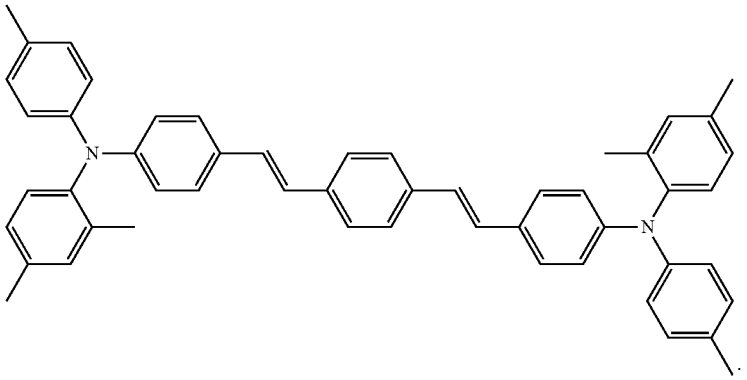

(BD-1)

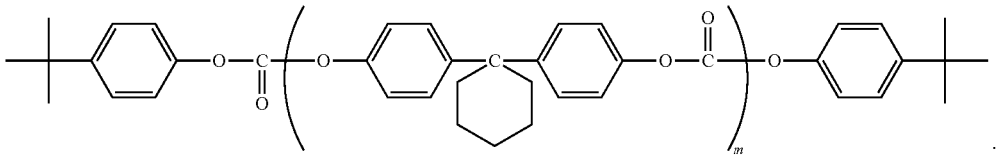

Charge Generation Layer

After dissolving 7.0 parts by mass of the compound represented by the Formula (H-5) as a hole transporting material, 3 parts by mass of a compound represented by Formula (E-2) below as an electron transporting material, 9.6 parts by mass of the polycarbonate resin having a repeating unit represented by the Formula (BD-1) as a resin binder, 0.04 parts by mass of a silicone oil (KF-54, manufactured by Shin-Etsu Polymer Co., Ltd.) and 0.1 parts by mass of dibutylhydroxytoluene (BHT) in 80 parts by mass of tetrahydrofuran, 0.3 parts by mass of a Y-type titanyl phthalocyanine (CG-1) was added thereto as a charge generating substance, and the resultant was subsequently subjected to a dispersion treatment using a sand grind mill to prepare a coating solution. This coating solution was coated on the above-formed charge transport layer, and the resultant was dried at 110° C. for 30 minutes to form a 15 μm-thick charge generation layer, whereby a 30 μm-thick laminate-type electrophotographic photoreceptor was obtained.

(E-2)

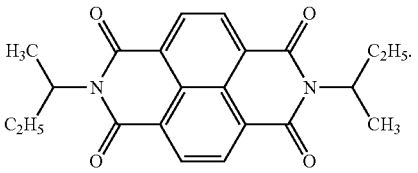

Example 2

An electrophotographic photoreceptor was produced in the same manner as in Example 1, except that the compound represented by the Formula (H-5) that was used in Example 1 was changed to the compound represented by the Formula (H-1).

Example 3

An electrophotographic photoreceptor was produced in the same manner as in Example 1, except that the compound represented by the Formula (H-5) that was used in Example 1 was changed to the compound represented by the Formula (H-20).

Example 4

An electrophotographic photoreceptor was produced in the same manner as in Example 1, except that the compound represented by the Formula (H-5) that was used in Example 1 was changed to the compound represented by the Formula (H-14).

Example 5

An electrophotographic photoreceptor was produced in the same manner as in Example 1, except that the compound represented by the Formula (H-5) that was used in Example 1 was changed to the compound represented by the Formula (H-27).

Example 6

An electrophotographic photoreceptor was produced in the same manner as in Example 1, except that the compound represented by the Formula (E-2) that was used in Example 1 was changed to a compound represented by the following Formula (E-5).

(E-5)

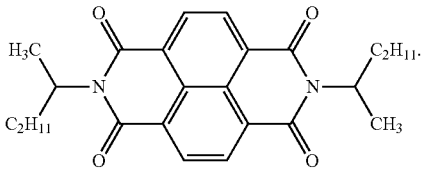

Example 7

An electrophotographic photoreceptor was produced in the same manner as in Example 2, except that the compound represented by the Formula (E-2) that was used in Example 2 was changed to the compound represented by the Formula (E-5).

Example 8

An electrophotographic photoreceptor was produced in the same manner as in Example 3, except that the compound represented by the Formula (E-2) that was used in Example 3 was changed to the compound represented by the Formula (E-5).

Example 9

An electrophotographic photoreceptor was produced in the same manner as in Example 4, except that the compound represented by the Formula (E-2) that was used in Example 4 was changed to the compound represented by the Formula (E-5).

Example 10

An electrophotographic photoreceptor was produced in the same manner as in Example 5, except that the compound represented by the Formula (E-2) that was used in Example 5 was changed to the compound represented by the Formula (E-5).

Example 11

An electrophotographic photoreceptor was produced in the same manner as in Example 1, except that the compound represented by the Formula (E-2) that was used in Example 1 was changed to a compound represented by the following Formula (E-11).

(E-11)

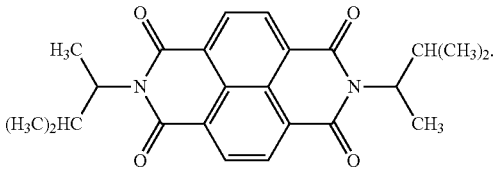

Example 12

An electrophotographic photoreceptor was produced in the same manner as in Example 2, except that the compound represented by the Formula (E-2) that was used in Example 2 was changed to the compound represented by the Formula (E-11).

Example 13

An electrophotographic photoreceptor was produced in the same manner as in Example 3, except that the compound represented by the Formula (E-2) that was used in Example 3 was changed to the compound represented by the Formula (E-11).

Example 14

An electrophotographic photoreceptor was produced in the same manner as in Example 4, except that the compound represented by the Formula (E-2) that was used in Example 4 was changed to the compound represented by the Formula (E-11).

Example 15

An electrophotographic photoreceptor was produced in the same manner as in Example 5, except that the compound represented by the Formula (E-2) that was used in Example 5 was changed to the compound represented by the Formula (E-11).

Example 16

An electrophotographic photoreceptor was produced in the same manner as in Example 6, except that the charge transporting material used in Example 6 was changed to the X-type metal-free phthalocyanine (CG-2) described in Japanese Unexamined Patent Application Publication No. 2001-228637.

Example 17

An electrophotographic photoreceptor was produced in the same manner as in Example 6, except that the charge transporting material used in Example 6 was changed to a hydroxygallium phthalocyanine (CG-3).

Example 18

An electrophotographic photoreceptor was produced in the same manner as in Example 6, except that the resin represented by the Formula (BD-1) that was used in the charge generation layer of Example 6 was changed to a resin represented by the following Formula (BD-2).

(BD-2)

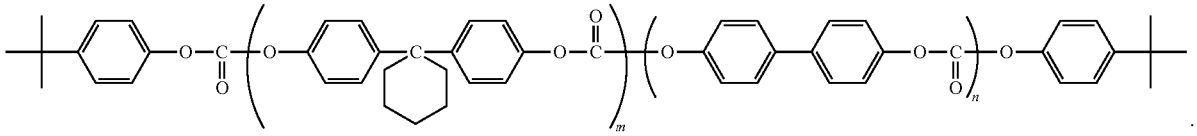

m:n = 85:15

Example 19

An electrophotographic photoreceptor was produced in the same manner as in Example 6, except that the resin represented by the Formula (BD-1) that was used in the charge generation layer of Example 6 was changed to a compound represented by the following Formula (BD-3).

(BD-3)

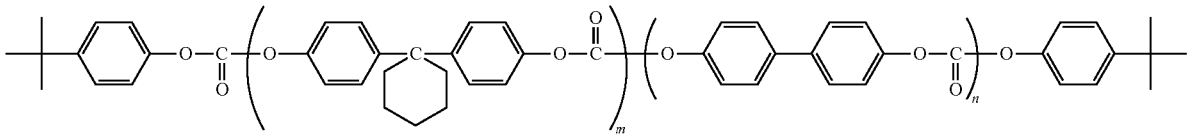

m:n = 60:40

Example 20

An electrophotographic photoreceptor was produced in the same manner as in Example 6, except that the resin represented by the Formula (BD-1) that was used in the charge generation layer of Example 6 was changed to a compound represented by the following Formula (BD-4).

(BD-4)

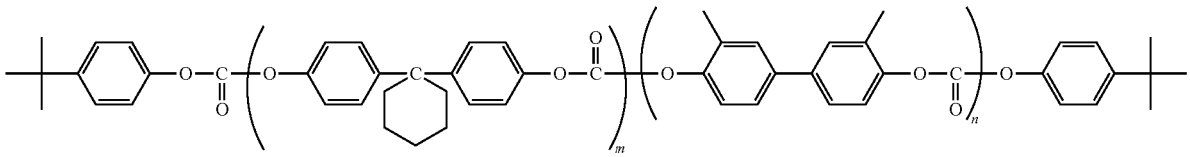

m:n = 60:40

Example 21

An electrophotographic photoreceptor was produced in the same manner as in Example 6, except that the resin represented by the Formula (BD-1) that was used in the charge generation layer of Example 6 was changed to a compound represented by the following Formula (BD-5).

(BD-5)

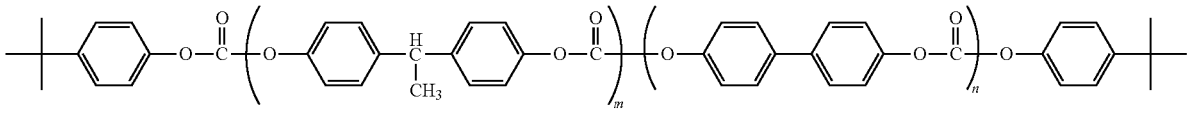

m:n = 85:15

Example 22

An electrophotographic photoreceptor was produced in the same manner as in Example 6, except that the resin represented by the Formula (BD-1) that was used in the charge generation layer of Example 6 was changed to a compound represented by the following Formula (BD-6).

(BD-6)

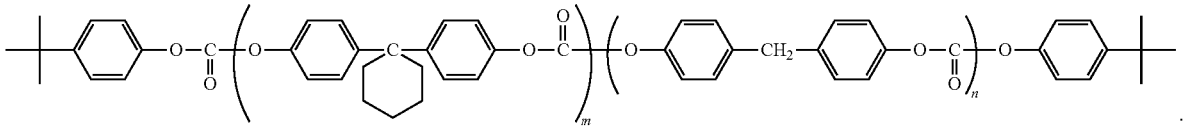

m:n = 50:50

Comparative Example 1

An electrophotographic photoreceptor was produced in the same manner as in Example 1, except that the compound represented by the Formula (E-2) that was used in Example 1 was changed to a compound represented by the following Formula (E-R1).

(E-R1)

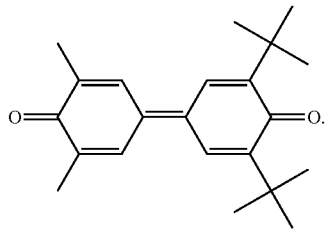

Comparative Example 2

An electrophotographic photoreceptor was produced in the same manner as in Example 1, except that the compound represented by the Formula (E-2) that was used in Example 1 was changed to a compound represented by the following Formula (E-R2).

(E-R2)

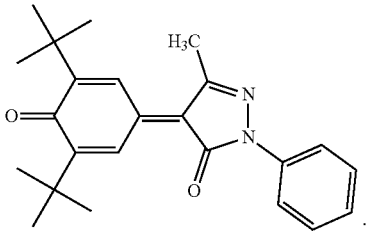

Single Layer-Type Photoreceptor

Example 23

As a conductive substrate, a 0.75 mm-thick aluminum tube machined to have a size of φ30 mm×244.5 mm (length) and a surface roughness (Rmax) of 0.2 μm was used.

After dissolving 7.0 parts by mass of the compound represented by the Formula (H-5) as a hole transporting material, 3 parts by mass of the compound represented by the Formula (E-2) as an electron transporting substance, 9.6 parts by mass of the polycarbonate resin (viscosity-average molecular weight: 50,000) having a repeating unit represented by the Formula (BD-1) as a resin binder, 0.04 parts by mass of a silicone oil (KF-54, manufactured by Shin-Etsu Polymer Co., Ltd.) and 0.1 parts by mass of dibutylhydroxytoluene (BHT) in 80 parts by mass of tetrahydrofuran, 0.3 parts by mass of the X-type metal-free phthalocyanine (CG-2) described in Example 16 was added thereto as a charge generating substance, and the resultant was subsequently subjected to a dispersion treatment using a sand grind mill to prepare a coating solution. This coating solution was coated on the above-described conductive substrate, and the resultant was dried at 100° C. for 60 minutes to form a single layer-type photosensitive layer having a thickness of about 25 μm, whereby a positively-chargeable single layer-type electrophotographic photoreceptor was obtained.

Example 24

An electrophotographic photoreceptor was produced in the same manner as in Example 23, except that the compound represented by the Formula (H-5) that was used in Example 23 was changed to the compound represented by the Formula (H-1).

Example 25

An electrophotographic photoreceptor was produced in the same manner as in Example 23, except that the compound represented by the Formula (H-5) that was used in Example 23 was changed to the compound represented by the Formula (H-20).

Example 26

An electrophotographic photoreceptor was produced in the same manner as in Example 23, except that the compound represented by the Formula (H-5) that was used in Example 23 was changed to the compound represented by the Formula (H-14).

Example 27

An electrophotographic photoreceptor was produced in the same manner as in Example 23, except that the compound represented by the Formula (H-5) that was used in Example 23 was changed to the compound represented by the Formula (H-27).

Example 28

An electrophotographic photoreceptor was produced in the same manner as in Example 23, except that the compound represented by the Formula (E-2) that was used in Example 23 was changed to the compound represented by the Formula (E-5).

Example 29

An electrophotographic photoreceptor was produced in the same manner as in Example 28, except that the compound represented by the Formula (H-5) that was used in Example 28 was changed to the compound represented by the Formula (H-1).

Example 30

An electrophotographic photoreceptor was produced in the same manner as in Example 28, except that the compound represented by the Formula (H-5) that was used in Example 28 was changed to the compound represented by the Formula (H-20).

Example 31

An electrophotographic photoreceptor was produced in the same manner as in Example 28, except that the compound represented by the Formula (H-5) that was used in Example 28 was changed to the compound represented by the Formula (H-14).

Example 32

An electrophotographic photoreceptor was produced in the same manner as in Example 28, except that the compound represented by the Formula (H-5) that was used in Example 28 was changed to the compound represented by the Formula (H-27).

Example 33

An electrophotographic photoreceptor was produced in the same manner as in Example 23, except that the compound represented by the Formula (E-2) that was used in Example 23 was changed to the compound represented by the Formula (E-11).

Example 34

An electrophotographic photoreceptor was produced in the same manner as in Example 33, except that the compound represented by the Formula (H-5) that was used in Example 33 was changed to the compound represented by the Formula (H-1).

Example 35

An electrophotographic photoreceptor was produced in the same manner as in Example 33, except that the compound represented by the Formula (H-5) that was used in Example 33 was changed to the compound represented by the Formula (H-20).

Example 36

An electrophotographic photoreceptor was produced in the same manner as in Example 33, except that the compound represented by the Formula (H-5) that was used in Example 33 was changed to the compound represented by the Formula (H-14).

Example 37

An electrophotographic photoreceptor was produced in the same manner as in Example 33, except that the compound represented by the Formula (H-5) that was used in Example 33 was changed to the compound represented by the Formula (H-27).

Comparative Example 3

An electrophotographic photoreceptor was produced in the same manner as in Example 23, except that the compound represented by the Formula (E-2) that was used in Example 23 was changed to the compound represented by the Formula (E-R1).

Comparative Example 4

An electrophotographic photoreceptor was produced in the same manner as in Example 23, except that the compound represented by the Formula (E-2) that was used in Example 23 was changed to the compound represented by the Formula (E-R2).

Evaluation of Photoreceptors

Fatigue Property (Electrical Property)

For the photoreceptors of Examples 1 to 22 and Comparative Examples 1 and 2, each photoreceptor was integrated into a commercially available 26-ppm monochrome laser printer (HL-2240) manufactured by Brother Industries, Ltd., and 5,000 prints of an image having a print area ratio of 4% were made at 10-second intervals under a low-temperature low-humidity environment of 10° C. and 20% RH, followed by measurement of the change in potential of the developing part.

For the photoreceptors of Examples 23 to 37 and Comparative Examples 3 and 4, each photoreceptor was integrated into a commercially available 16-ppm color LED printer (HL-3040) manufactured by Brother Industries, Ltd., and 5,000 prints of an image having a print area ratio of 4% were made at 10-second intervals under a low-temperature low-humidity environment of 10° C. and 20% RH, followed by measurement of the change in potential of the developing part of each black-toner photoreceptor.

The results of these evaluations are shown in Tables 13 and 14 below.

TABLE 13

| | | Charge generation layer or single layer-type photosensitive layer material | | | | Property |
|---|---|---|---|---|---|---|
| | Photoreceptor layer structure | Electron transporting material Compound | Charge generating material Compound | Hole transporting material Compound | Resin Compound | Change in environmental potential (V) |
| Example 1 | laminated | E-2 | CG-1 | H-5 | BD-1 | 17 |
| Example 2 | laminated | E-2 | CG-1 | H-1 | BD-1 | 20 |
| Example 3 | laminated | E-2 | CG-1 | H-20 | BD-1 | 19 |
| Example 4 | laminated | E-2 | CG-1 | H-14 | BD-1 | 18 |
| Example 5 | laminated | E-2 | CG-1 | H-27 | BD-1 | 23 |
| Example 6 | laminated | E-5 | CG-1 | H-5 | BD-1 | 14 |
| Example 7 | laminated | E-5 | CG-1 | H-1 | BD-1 | 15 |
| Example 8 | laminated | E-5 | CG-1 | H-20 | BD-1 | 17 |
| Example 9 | laminated | E-5 | CG-1 | H-14 | BD-1 | 15 |
| Example 10 | laminated | E-5 | CG-1 | H-27 | BD-1 | 18 |
| Example 11 | laminated | E-11 | CG-1 | H-5 | BD-1 | 18 |
| Example 12 | laminated | E-11 | CG-1 | H-1 | BD-1 | 21 |
| Example 13 | laminated | E-11 | CG-1 | H-20 | BD-1 | 20 |
| Example 14 | laminated | E-11 | CG-1 | H-14 | BD-1 | 21 |
| Example 15 | laminated | E-11 | CG-1 | H-27 | BD-1 | 22 |
| Example 16 | laminated | E-5 | CG-2 | H-5 | BD-1 | 22 |
| Example 17 | laminated | E-5 | CG-3 | H-5 | BD-1 | 18 |

TABLE 13-continued

| | | Charge generation layer or single layer-type photosensitive layer material | | | | Property |
|---|---|---|---|---|---|---|
| | Photorecept or layer structure | Electron transporting material Compound | Charge generating material Compound | Hole transporting material Compound | Resin Compound | Change in environmental potential (V) |
| Example 18 | laminated | E-5 | CG-1 | H-5 | BD-2 | 14 |
| Example 19 | laminated | E-5 | CG-1 | H-5 | BD-3 | 16 |
| Example 20 | laminated | E-5 | CG-1 | H-5 | BD-4 | 17 |
| Example 21 | laminated | E-5 | CG-1 | H-5 | BD-5 | 14 |
| Example 22 | laminated | E-5 | CG-1 | H-5 | BD-6 | 15 |

TABLE 14

| | | Charge generation layer or single layer-type photosensitive layer material | | | | Property |
|---|---|---|---|---|---|---|
| | Photorecept or layer structure | Electron transporting material Compound | Charge generating material Compound | Hole transporting material Compound | Resin Compound | Change in environmental potential (V) |
| Example 23 | single layer | E-2 | CG-2 | H-5 | BD-1 | 20 |
| Example 24 | single layer | E-2 | CG-2 | H-1 | BD-1 | 22 |
| Example 25 | single layer | E-2 | CG-2 | H-20 | BD-1 | 21 |
| Example 26 | single layer | E-2 | CG-2 | H-14 | BD-1 | 20 |
| Example 27 | single layer | E-2 | CG-2 | H-27 | BD-1 | 25 |
| Example 28 | single layer | E-5 | CG-2 | H-5 | BD-1 | 16 |
| Example 29 | single layer | E-5 | CG-2 | H-1 | BD-1 | 17 |
| Example 30 | single layer | E-5 | CG-2 | H-20 | BD-1 | 19 |
| Example 31 | single layer | E-5 | CG-2 | H-14 | BD-1 | 18 |
| Example 32 | single layer | E-5 | CG-2 | H-27 | BD-1 | 19 |
| Example 33 | single layer | E-11 | CG-2 | H-5 | BD-1 | 22 |
| Example 34 | single layer | E-11 | CG-2 | H-1 | BD-1 | 21 |
| Example 35 | single layer | E-11 | CG-2 | H-20 | BD-1 | 24 |
| Example 36 | single layer | E-11 | CG-2 | H-14 | BD-1 | 24 |
| Example 37 | single layer | E-11 | CG-2 | H-27 | BD-1 | 25 |
| Comparative Example 1 | laminated | E-R1 | CG-1 | H-5 | BD-1 | 44 |
| Comparative Example 2 | laminated | E-R2 | CG-1 | H-5 | BD-1 | 40 |
| Comparative Example 3 | single layer | E-R1 | CG-2 | H-5 | BD-1 | 54 |
| Comparative Example 4 | single layer | E-R2 | CG-2 | H-5 | BD-1 | 46 |

As apparent from the above Tables, it was confirmed that, in the photoreceptors of Examples in which a specific combination of a charge generating material and an electron transporting material was used in each photosensitive layer, the potential fluctuation in a low-temperature environment was suppressed as compared to the photoreceptors of Comparative Examples in which different combinations were used.

What is claimed is:

1. An electrophotographic photoreceptor, comprising:

a conductive substrate; and a photosensitive layer that is provided on the conductive substrate, that is a laminate-type positively-chargeable photosensitive layer in which a charge transport layer and a charge generation layer are sequentially laminated on the conductive substrate in that order, wherein (a) the charge transport layer consists essentially of:

a hole transporting material that comprises a compound represented by Formulae (2) to (4) below; and a resin binder that comprises a polycarbonate resin having a repeating unit represented by Formula (6) below; and (b) the charge generation layer contains:

a charge generating material selected from the group consisting of titanyl phthalocyanines, metal-free phthalocyanines, chlorogallium phthalocyanines and hydroxygallium phthalocyanines;

a hole transporting material that comprises a compound represented by Formulae (2) to (4) below;

an electron transporting material that is any one compound represented by Formulae (E-2), (E-5) and (E-11) below; and a resin binder that comprises a polycarbonate resin having a repeating unit represented by Formula (6) below:

(2)

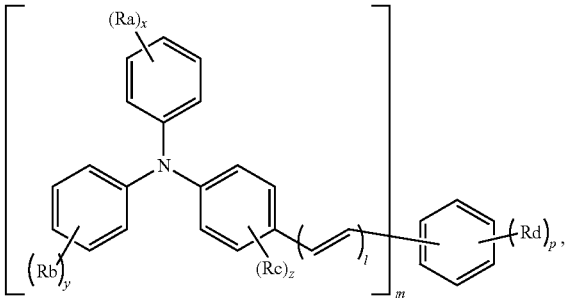

(3)

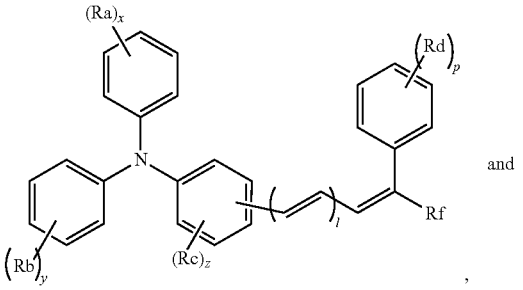

and (4)

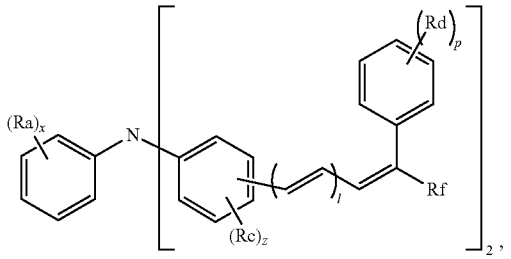

where Ra represents a methyl group in Formula 2; and Ra represents a hydrogen atom, an optionally branched alkyl group having 1 to 6 carbon atoms, an alkoxy group having 1 to 6 carbon atoms, a phenyl group optionally having a substituent, or a styryl group optionally having a substituent in Formula (3) and Formula (4);

where Rd represents a hydrogen atom, an optionally branched alkyl group having 1 to 6 carbon atoms, an alkoxy group having 1 to 6 carbon atoms, a phenyl group optionally having a substituent, or a styryl group optionally having a substituent;

where Rb represents a methyl group in Formula (2); and Rb represents a hydrogen atom, an optionally branched alkyl group having 1 to 6 carbon atoms, or an alkoxy group having 1 to 6 carbon atoms in Formula (3);

where Rc represents a hydrogen atom, an optionally branched alkyl group having 1 to 6 carbon atoms, or an alkoxy group having 1 to 6 carbon atoms;

where Rf represents a hydrogen atom, an optionally branched alkyl group having 1 to 6 carbon atoms, an alkoxy group having 1 to 3 carbon atoms, a phenyl group in Formula (4) but not in Formula (3), which phenyl group in Formula (4) optionally has a substituent, a styryl group optionally having a substituent, or a 4-phenyl butadiene group optionally having a substituent; and where x and y each represent an integer of 1 to 5 and are different in Formula (2); x and y each represent an integer of 0 to 5 in Formula (3); x represents an integer of 0 to 5 in Formula (4); p represents an integer of 0 to 5; z represents an integer of 0 to 4; l represents an integer of 0 to 2; and m represents an integer of 2 to 4;

(6)

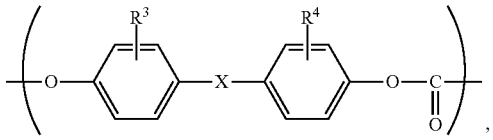

where $R^3$ and $R^4$ each represent a hydrogen atom, a methyl group, or an ethyl group;

where X represents an oxygen atom, a sulfur atom, or $—CR^5R^6$; and where $R^5$ and $R^6$ each represent a hydrogen atom, an alkyl group having 1 to 4 carbon atoms, or a phenyl group optionally having a substituent, or $R^5$ and $R^6$ are optionally cyclically bound to form a cycloalkyl group having 4 to 6 carbon atoms, the cycloalkyl group optionally has a substituent; and $R^5$ and $R^6$ are optionally the same or different; and (E-2)

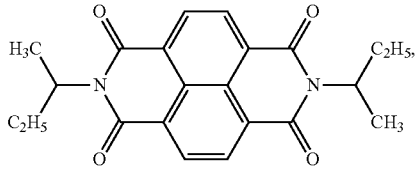

(E-5)

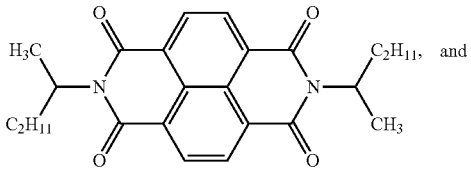

(E-11)

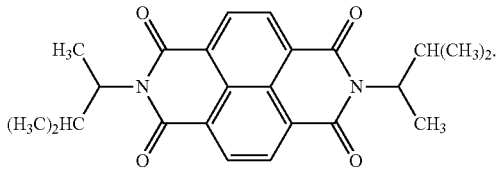

2. A method of producing an electrophotographic photoreceptor according to claim 1, the method comprising:

providing the conductive substrate; and forming a photosensitive layer that is a laminate-type positively-chargeable photosensitive layer on the conductive substrate by:

providing a coating solution for coating the charge transport layer;

coating the coating solution for coating the charge transport layer onto the conductive substrate to provide the charge transport layer;

providing a coating solution for coating the charge generating layer; and coating the coating solution for coating the charge generation layer onto the charge transport layer to provide the charge generation layer.

3. An electrophotographic apparatus equipped with the electrophotographic photoreceptor according to claim 1.

4. The electrophotographic photoreceptor according to claim 1, wherein the charge generating material of the charge generation layer comprises a titanyl phthalocyanine.

* * * * *